US006121597A

United States Patent [19]

Igota et al.

[11] Patent Number: 6,121,597

[45] Date of Patent: Sep. 19, 2000

[54] PACKAGING BAG FOR USE IN A MICROWAVE OVEN

[75] Inventors: Shoji Igota; Takeshi Fukumoto, both of Kawasaki; Masanori Shibasaki, Tokyo, all of Japan

[73] Assignees: Ace Package Co., Ltd., Kawasaki; Ajinomoto Co., Inc., Tokyo, both of Japan

[21] Appl. No.: 09/189,942

[22] Filed: Nov. 12, 1998

[30] Foreign Application Priority Data

Jan. 30, 1998 [JP] Japan ..... 10-018372
Apr. 23, 1998 [JP] Japan ..... 10-112962

[51] Int. Cl.[7] ..... H05B 6/80

[52] U.S. Cl. ..... 219/725; 99/DIG. 14; 428/35

[58] Field of Search ..... 219/725, 727, 219/730; 428/35; 99/DIG. 14

[56] References Cited

U.S. PATENT DOCUMENTS 3,637,132 1/1972 Gray .
3,973,045 8/1976 Brandberg et al. ..... 426/110
4,268,738 5/1981 Flautt, Jr. et al. ..... 219/759
4,705,707 11/1987 Winter ..... 428/34.3
4,874,620 10/1989 Mendenhall et al. .
5,419,638 5/1995 Jamison .
5,650,084 7/1997 Bley ..... 219/727

FOREIGN PATENT DOCUMENTS 0 218 419 4/1987 European Pat. Off. .
0 795 482 9/1997 European Pat. Off. .

*Primary Examiner*—Teresa Walberg
*Assistant Examiner*—Jeffrey Pwu
*Attorney, Agent, or Firm*—Oblon, Spivak, McClelland, Maier & Neustadt, P.C.

[57] ABSTRACT

This invention provides a packaging bag for a microwave oven capable of allowing vapor generatetd during microwave heating to escape surely, which comprises a bag body comprising an upper side sheet portion and an underside sheet portion and an upper fin seal portion formed on the upper side sheet portion formed on the upper side sheet portion, wherein said upper fin seal portion is formed of heat-sealed laminated films comprising an inner layer film and an outer layer film, and wherein said upper fin seal portion comprises a non-sealed portion connecting with a container portion of the bag body, a projected portion projected from an inside end of a heat-scaled portion, and a weakly joined portion having a peel strength of 0.1 to 15 g/15 mm width formed between the inner layer film and the outer layer film at least surrounding the projected portion and connected with an outside end of the upper fin seal portion.

12 Claims, 24 Drawing Sheets

PACKAGING BAG FOR USE IN A MICROWAVE OVEN

BACKGROUND OF THE INVENTION

This invention relates to a packaging bag for a microwave oven capable of heating to cook an article to be cooked, such as ingredients in Chinese foods and curry by the oven.

When a packaged article to be cooked, which generate vapor upon heating, is heated by a microwave oven, there is a fear of bursting of the package by the increase of internal pressure. Accordingly, the heating of the packaged article is, in general, carried out by immersing it in boiling coater.

In order to cook the packaged article by a microwave oven, it is necessary to provide a means for the escape of vapor without liquid escape, such as the attachment of a nonreturn valve or partial cutting of the package by a scissors immediately before cooking.

However, the nonreturn valve has not been spread because of having a problem in incomplete working and expensiveness. There is also a possibility that a liquid portion of the article boils over.

Japanese Patent KOKAI 9-27218 discloses a packaging bag for microwave heating made of a laminated film composed of a heat-resistant thermoplastic resin outer layer, a sealant inner layer interposing a releasing agent layer in lines therebetween, as shown in FIGS. 27, 28. Both ends of the bag are heat-sealed, and during beating by a microwave oven, the inner layer is ruptured at the heat-sealed portion by the increase of internal pressure to release vapor through the ruptured portion. However, this bag still has a problem of not forming a vapor passage smoothly and moreover liquid escape problem.

SUMMARY OF THE INVENTION

An object of the invention is to provide a packaging bag for a microwave oven which does not leak liquid before microwave heating, which allows vapor generated during microwave heating to escape surely and smoothly without or with rare escape of a liquid portion of a packaged article to be cooked.

The present invention provides a packaging bag for a microwave oven which has solved the above object which comprises a bag body comprising an upper side sheet portion and an underside sheet portion and an upper fin seal portion formed on the upper side sheet portion formed on the upper side sheet portion, wherein said upper fin seal portion is formed of heat-sealed laminated films comprising an inner layer film and an outer layer film, and wherein said upper fin seal portion comprises a non-sealed portion connecting with a container portion of the bag body, a projected portion projected from an inside end of a heat-sealed portion, and a weakly joined portion having a peel strength of 0.1 to 15 g/15 mm width formed between the inner layer film and the outer layer film at least surrounding the projected portion and connected with an outside end of the upper fin seal portion.

BRIEF DESCRIPTION OF THE DRAWINGS

FIGS. 1–3 illustrates proceeding of microwave heating, and FIG. 3 is a section of the above bag containing an article to be cooked in an inflated state by microwave heating

Figure 1:
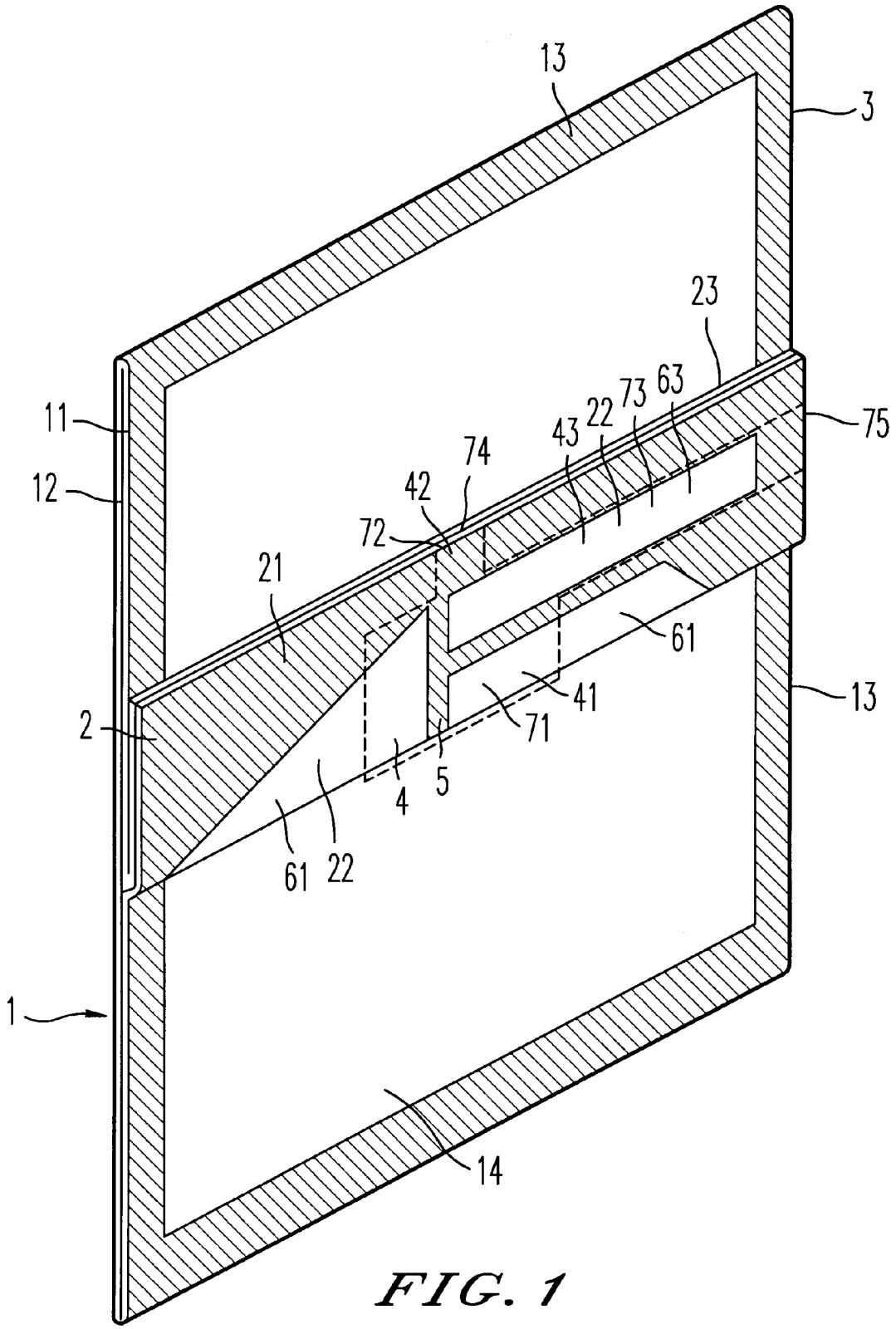
FIG. 1 is a perspective view of a packaging bag for a microwave oven embodying the invention.

1 . . . Bag body
11, 11*a*, 11*b* . . . Upper side sheet portion
12 . . . Underside sheet portion
13 . . . Side fin seal portion
14 . . . Container portion
2 . . . Upper fin seal portion
21 . . . Heat-sealed portion
22 . . . Non-sealed portion
23 . . . Free end
24 . . . Weakly heat-sealed portion
3 . . . Packaging sheet
31 . . . Outer layer film
32 . . . Inner layer film
33 . . . Releasing agent layer
4 . . . Weakly joined portion
41 . . . Greatest rectangle portion
42 . . . Smallest rectangle portion
43 . . . Right rectangle portion
44 . . . Trapezoid portion
5 . . . Jetty (projected portion)
51 . . . First jetty
52 . . . Second jetty
53 . . . Bridge portion
54 . . . Step portion
55 . . . Corner
61 . . . First subsidiary chamber
62 . . . Second subsidiary chamber
63 . . . Non-sealed window portion
71 . . . Vapor pocket
72 . . . First vapor passage
73 . . . Second vapor passage
74 . . . First vapor port
75 . . . Second vapor port
76 . . . Notch
77 . . . Recess
8 . . . Article to be cooked
9 . . . Strongly joined spot portion

DETAILED DESCRIPTION OF THE INVENTION

The packaging bag of the invention comprises the bag body and an upper fin seal portion and made of a packaging sheet comprising an outer layer film and an inner layer film at least at the upper fin seal portion.

The outer layer film of the packaging sheet has heat resistance at least at 170° C., preferably 225° C. for cooking time, e.g. 6 minutes. Illustrative of suitable outer layer films are biaxially stretched nylon film, biaxially stretched polyethylene terephthalate film, biaxially stretched polypropylene film, metallized films, various coated films, and laminated films containing the above film, etc. A suitable thickness of the outer layer film is 4 to 50 μm, preferably to 30 μm.

The inner layer film has heat sealability. Illustrative of suitable inner layer films are thermoplastic resin films, such as linear low density polyethylene film, low density polyethylene film, medium density polyethylene film, high density polyethylene film, very low density polyethylene film, unstretched polypropylene film, ethylene-vinyl acetate copolymer resin film, ethylene-acrylic acid copolymer resin film, ethylene-ethyl acrylate copolymer resin film, ethylene-metahcrylic acid copolymer resin film, ethylene-methyl acrylate copolymer resin film, ionomer resin film, and laminated films containing the above film, etc. A suitable thickness of the inner layer film is 10 to 150 μm, preferably 30 to 100 μm.

The strength of the inner layer film must be broken by the tensile stress induced by the deformation of the upper fin seal portion caused by the pressure of vapor generated by microwave heating. A suitable strength is 50 to 200 kg-cm/mm at 20° C. an impact strength. Moreover, it is preferable to have a ratio of tear strength in lateral direction (CD)/longitudinal direction (MD) of 4 or more, measured by the Elmendorf method with a notch. The strength can be adjusted by selecting the material and thickness of the inner layer film, the type and coating amount of the releasing agent, or the like.

The inner layer film is laminated to the outer layer film at least in the area surrounding the non-joined or weakly joined portion. The lamination may be carried out by conventional manner, such as heating followed by passing through nip rolls. An adhesive may be applied between the inner layer film and the outer layer film.

A weakly joined portion is provided in the packaging sheet between the inner layer film and the outer layer film. A suitable peel strength is 0.1 g/15 mm width or more, preferably 0.5 g/15 mm width or more, and 20 g/15 mm width or less, preferably 15 g/15 mm width or less, more preferably 10 mm width or less, more preferably 7 g/15 mm width or less. When the peel strength is less than 0.1 g/15 mm width, delamination occurs during charging al article to be cooked, physical distribution or the like to degrade appearance and oxygen barrier ability. When the peel strength exceeds 20 g/15 mm width, formation of a vapor passage is difficult and there is a possibility that the rupture of the side fin seal portions occurs.

Figure 26:
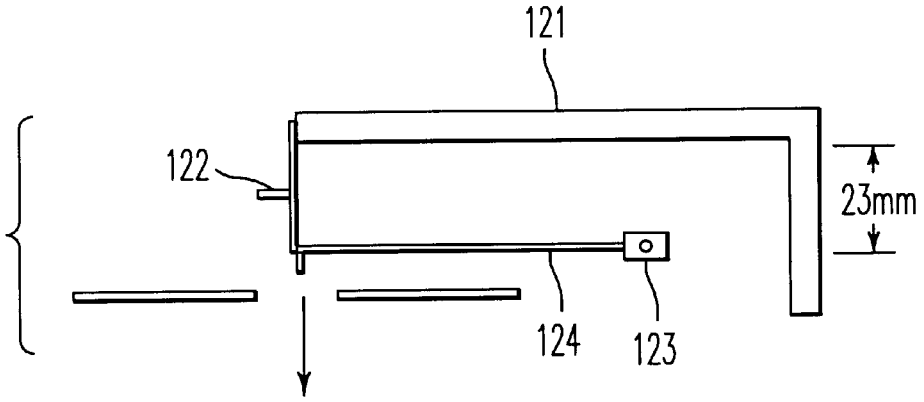
FIG. 26 illustrates an apparatus for measuring peel strength.
Figure 27:
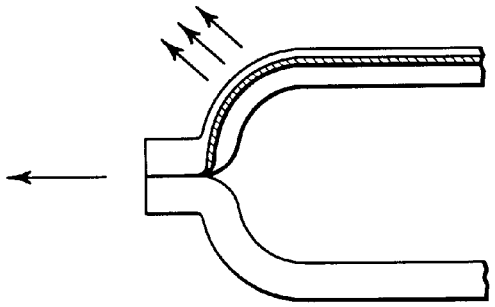
FIG. 27 is a partial section of a known packaging bag.
Figure 28:
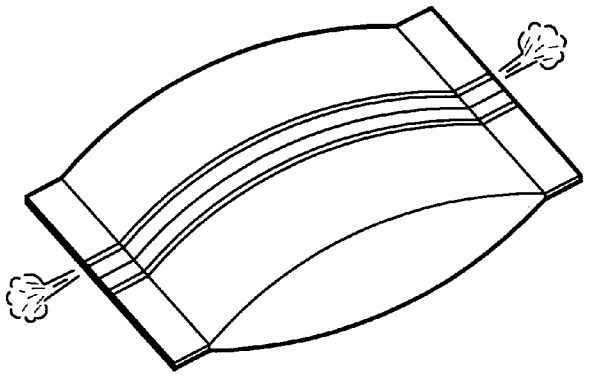
FIG. 28 is a perspective view thereof.

The peel strength was measured by using the apparatus shown in FIG. 26. An end of a test piece is delaminated, and one of the delaminated end is fixed to a reverse L-shaped plate 121 by a cellophane adhesive tape. The other delaminated end is fixed to a pulling member 124 connected to a motor 123. Then, the motor 123 is maneuvered to move the pulling member 124 downward, and tensile load is measured. Measuring conditions are as follows:

Test piece 15 mm width×50 mm length

Full scale: 25 g

Pulling speed: about 100 mm/min

Grasp length: 25 mm

Measure unit: g/15 mm width

Moving distance of test piece: 17 mm

Measuring apparatus: "HANDLE-O-METER", Kumagai Riki Kogyo Kabushiki Kaisha

The weakly joined portion can be formed by adjusting lamination conditions, such as pressure and temperature. However, it is preferable to use a releasing agent which renders the adhesive force between the inner layer film and the outer layer film. Especially, when an adhesive for lamination, such as urethane adhesive, is used, the releasing agent decreases the adhesive strength between the adhesive and one or both films. Illustrative of the releasing agents are polyamide/nitrocellulose based, acrylic/polyethylene based, cyclized rubber based, chlorinated polyolefin based, etc. Particularly preferable releasing agents are cyclized rubber-based releasing agents because of stable peel strength. The peel strength can be adjusted by adding an organic or inorganic material. Suitable organic materials belong to lubricant, such as paraffins, waxes, fatty amides bis-fatty amides, fatty esters, fatty acid, fatty acid metal salts. Suitable inorganic materials belong to fillers, such as calcium carbonate, magnesium carbonate, potassium carbonate, zinc carbonate, talc, silicon oxide, magnesium oxide, aluminum oxide, titanium oxide, barium sulfate, sodium silicate, magnesium silicate, diatomaceous earth, caolin, clay, etc. A suitable content of the organic or inorganic material is 0.1 wt. % or more, preferably 1 wt. % or more, more preferably 2 wt. % or more and 20 wt. % or less, prefeably 10 wt. % or less.

As the form of the bag, at least, both sides are heat-sealed in fin-shaped. The both sides may be gusseted to form a gusset bag. The bag can be made of one sheet, two sheets or three sheets. In the case of gusset bag, in general, three to five sheets may be used. In the case of one sheet, the superimposed ends potion may be allowed to form the front or rear end fin seal portion or the upper fin seal portion. The position of the upper fin seal portion may be not at the center but at another position in the range from about 5 to 95% the total longitudinal width. A suitable width of the side fin seal portion is about 0.5 to 30 mm, in usual, about 3 to 15 mm, and a suitable longitudinal width of the upper fin seal portion is about 10 to 100 mm, in usual, about 20 to 40 mm.

The main portion of the bag body surrounded by the side fin seal potions, in the case of four-sided fin seal bag, is the container portion containing the article to be cooked.

The type of the article to be cooked is not restricted, and illustrative of the articles and various frozen foods, such as Chinese foods, e.g. mabo tofu, ingredients of chuka-don, shrimp chili sauce and meat dumpling, curry, Japanese hotchpotch with stock, chow mein, boiled rice, boiled square pork with sauce, roast meat with sauce, stew, and soup, and the frozen foods may be in a half-cooked state, or completely cooked.

The upper fin seal portion comprises a non-scaled portion, a projected portion, and a non-joined or weakly joined portion.

In the non-sealed portion, heat sealing in not made between the inner layer films of the packaging sheets faced each other. The non-sealed portion is connected with a container portion of the bag body. That is, when the packaging bag is heated, vapor generated from the article to be cooked enters the non-sealed portion from the containing portion. The non-sealed portion is preferably formed deeper toward the center so that the vapor is concentrated on the projected portion.

The projected portion is present in the heat-sealed portion, and is projected from an inside end of the heat-sealed portion to the non-joined or weakly joined area. That is, in the projected portion, heat sealing is made between the inner layer films of the packaging sheets faced each other. The shape of the projected portion may be jetty, bar, rectangular frame, spot, corner or the like. A suitable number of the projected portions is one to about five.

A preferable projected portion is a combination of a jetty and a bridge, wherein the jetty(s) is projected from one or both ends of the bridge. When the jetties are formed on ends of the bridge, the opening area becomes great as a whole to ensure the escape of vapor. When the jetty is formed on only one end of the bridge, it is preferable to recess the other end of the bridge by 1 mm or more, preferably 2 mm or more in depth, and thereby, to close a vapor passage can be prevented.

A suitable distance between the end of the projected portion and the closest inside end of the heat-sealed potion is about 1 to 15 mm, in usual, about 3 to 8 mm. A suitable width of the projected portion is about 2 to 10 mm, preferably 3 to 6 mm. When the width is less than 2 mm, it is difficult to form all enough opening. When the width exceeds 10 mm, occasionally, an opening can not form smoothly. Upon microwave heating, vapor inflates the non-sealed portion, and pulling force is concentrated on the end of the projected portion to break the inner layer film there.

The weakly joined portion is formed between the inner layer film and the outer layer film, and can be divided into the part forming a vapor pocket and the part forming a vapor passage.

The part forming a vapor pocket is provided surrounding the end of the projected portion, and functions to inflate between the inner layer film and the outer layer film surrounding the broken part and assists to form the vapor passage. A suitable area of the part forming a vapor pocket is about 1 to 100 $cm^2$.

The part forming a vapor passage is connected with an outside end of the upper fin seal portion, and allows vapor to escape. The number of the vapor passage is one, two or more. When the length of the vapor passage is long, the formation of the vapor passage is facilitated by rendering the part non-sealed between the inner layer films of the packaging sheets. It is preferable to form the vapor passage narrower toward the vapor port, e.g. in a taper shape. Thereby, the escape of vapor is facilitated, and folding of the upper fin seal portion is prevented. A suitable width of the vapor port is 8 to 20 mm, preferably 9 to 12 mm.

It is preferable to provide a strongly joined spot portion for facilitating the breakage of the inner layer film. In the strongly joined spot portion, the inner layer films faced each other are strongly joined without releasing agent layer. By providing the strongly joined portion, a great force for rupture works on the inner layer film between the end of the projected portion and the strongly joined spot portion, and facillitates the breakage at the end of the projected portion. The strongly joined spot portion also functions to prevent the opening formed by the breakage from closing, because of decreasing elongation of the inner layer film around the breakage. A suitable distance of the strongly joined spot portion from the end of the projected portion is 0.1 to 10 mm, preferably 1 to 4 mm.

The upper fin seal portion is preferably turned to lie, and imparted with turning habit. A means for imparting the turning habit is heating in the lied state.

EXAMPLES

Examples 1

Figure 2:
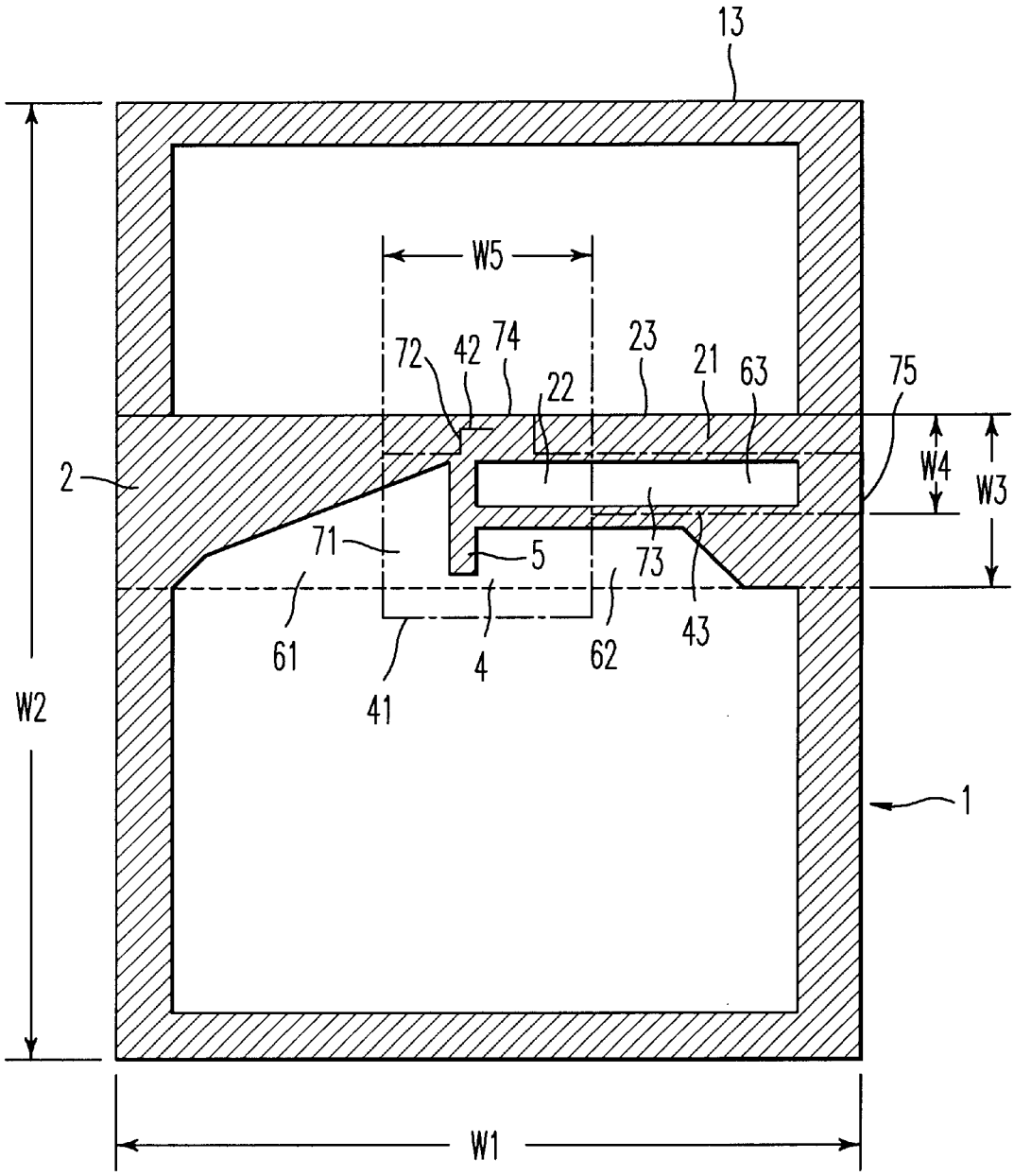
FIG. 2 is a plan view thereof.

An example of the packaging bag of the invention is illustrated in FIGS. 1–2.

The bag is a four-sided fin seal bag, and composed of a bag body 1 and an upper fin seal portion 2. The lateral width (W1) of the bag is 130 mm, and the longitudinal width (W2) is 170 mm. The longitudinal width (W3) of the upper fin seal portion is 30 mm.

The bag is made of one sheet of a packaging sheet 3 which is a laminated film consisting of an outer layer film 31, an inner layer film 32 and a releasing agent layer 33 provided on the weakly joined portion 4. The outer layer film 31 is a biaxially stretched nylon film 15 $\mu$m in thickness. The inner layer film 32 is a linear low density polyethylene film 30 $\mu$m in thickness. The thickness of the releasing agent layer 33 is 0.1 to 5 $\mu$m.

The bag body 1 is composed of an upper side sheet portion 11 and an underside sheet potion 12, and all sides are heat-sealed to form side fin seal portions 13. The part surrounded by the side fin seal portions 13 is a container portion 14 for containing an article to be cooked.

The upper fin seal portion 2 is formed around the center of the upper side sheet portion 11, and composed of heat-sealed portions 21 including portion 4 and a jetty as the projected portion 5, and non-sealed portions 22 including subsidiary chambers 61, 62 and a non-sealed window portion 63.

In FIG. 2, the underside of the heat-sealed portion 21 is obliquely raise from the left end, and turned to form a gentle oblique line up to almost the central portion of the upper fin seal portion 2. Then, descends 18 mm straight to form the jetty 5 having a width of 4 mm and a height of 7 mm. The underside of the heat-sealed portion 21 goes from the base of the jetty 5 in parallel to the free end 23 at a distance of 21 mm (W4), turns downward to form an oblique line, and then returns in parallel to the free end to reach lie other end. The central portions of the heat-sealed portion 21 may be partially heat-sealed, e.g. in island shape in order to improve flexibility.

The left portion surrounded by the turned oblique lines, straight descending line and the base line of the upper fin seal portion 2 is the first subsidiary chamber 61, and the right portion surrounded by the jetty 5, the straight line in parallel to the free end 23, the oblique line, and the base line of the upper fin seal portion 2 is the second subsidiary chamber 62.

The non-sealed window portion 63 is in a form of rectangle surrounded by the heat-sealed portion 21, and has a width of 7 mm. The width of the heat-sealed portion surrounding the window portion 63 is 11 mm on the upper side, 4 mm on the left side, 3 mm on the underside, and 10 mm on the right side.

In FIG. 2, the releasing agent which renders the heat-sealed portion in a weakly joined state is applied to the part surrounded by a dashed line, i.e. a combination of three rectangles 41, 42, 43. The lateral width (W5) of the greatest rectangle 41 is 36 mm, the distance between the left side of the rectangle 41 and the jetty 5 is 11 mm, and the right side and the jetty 5 is 21 mm. The distance between the underside and the lower end of the jetty 5 is 6 mm. The lateral width of the smallest rectangle 42 connected to the upside of the greatest rectangle 41 is 12 mm and the longitudinal width is 10 mm. The upper side of the smallest rectangle 42 conforms to the free end 23. The right rectangle 43 connected to the right side of the greatest rectangle 41 is apart from the free end 23 at a distance of 10 mm, and has a longitudinal width of 9 mm. The right side of the right rectangle 43 conforms to the right side of the upper fin seal portion. After the inner layer film 32 will be broken, the greatest rectangle portion 41 constitutes a vapor pocket 71, the smallest rectangle portion 42 becomes a first vapor passage 72 and of the right rectangle portion 43 becomes a second vapor passage 73.

Upon making the bag, the releasing agent is applied to the three rectangle portions 41, 42, 43 of the outer layer film 31 by a gravure coater in a thickness of 0.1 to 5 $\mu$m to form the releasing agent layer 33. Then, an urethane-based adhesive is applied to the whole surface of the outer layer film 31 by a dry laminator to laminate the inner layer film 32.

The packaging sheet 3 thus produced is folded so that the inner layer film 32 becomes inside, and the free end of the folded packaging sheet 3 is heat-sealed by a heat-sealing bar having indentations corresponding to the non-sealed portions to form the upper fin seal portion 2.

Subsequently, the packaging sheet 3 is picked up, and folded again while locating the upper fin seal portion 2 the center of the upside. Then, three sides i.e. one side and both folded ends are heat-sealed in a state that the upper fin seal portion 2 is turned on one side. Thereby, turning habit is imparted to the upper fin seal portion 2. An article to be cooked is put in the bag through the unsealed side, and the unsealed side is heat-sealed to complete the bag containing the article.

Figure 3:
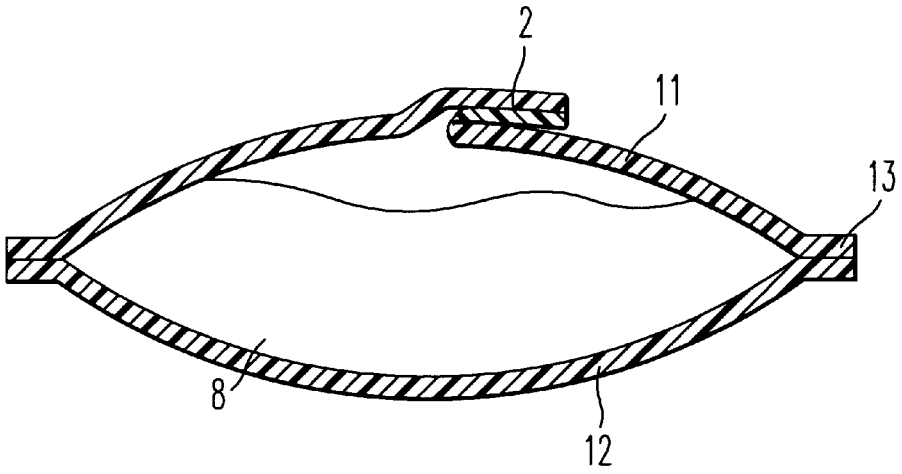
Figure 4:
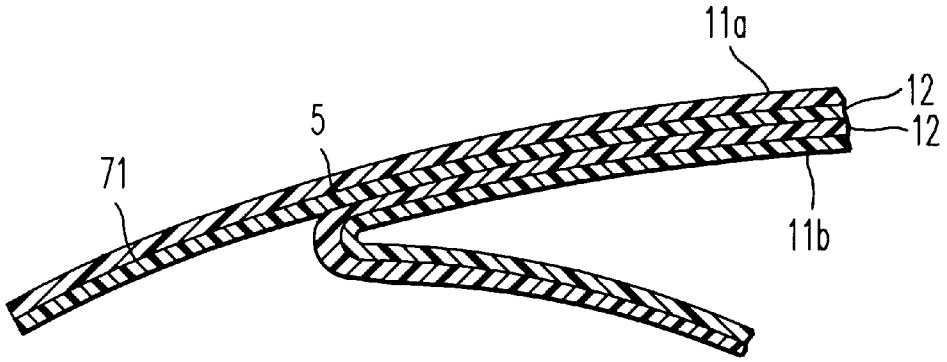
FIG. 4 is a partial section around the upper fin seal portions illustrating a standing state during proceeding of the microwave heating.
Figure 5:
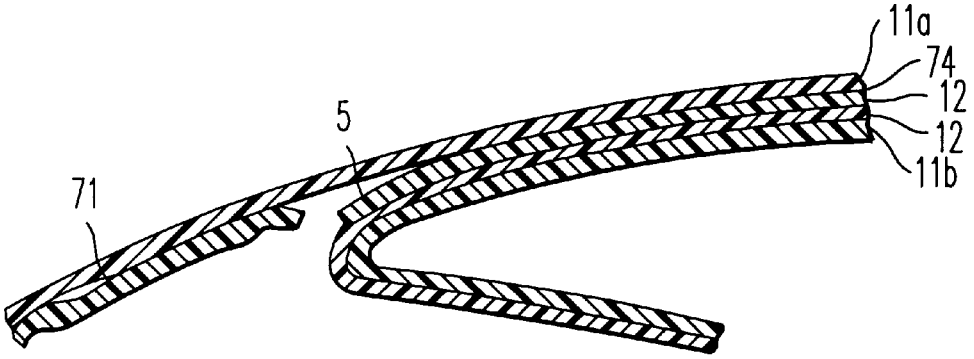
FIG. 5 illustrates a breaking state of the inner layer film.

The packaging bag containing the article to be cooked is put in a microwave oven, and heated by working the oven. The bag inflates by the generated vapor (and air expansion), as shown in FIG. 3, and the vapor gradually enters the subsidiary chambers 61, 62 to stand obliquely the upper fin seal portion 2, as shown in FIG. 4. At that time, the oblique forms of both subsidiary chambers 61, 62, especially the first subsidiary chamber 61 which recessed deeply, facilitate entering of the vapor. Since the inner layer films 32 faced each other are bonded by heat-sealing also at the jetty 5 portion, the expanding force by the increase of internal pressure is gradually concentrated to around the end of the jetty 5 to pull down-ward the inner layer fin 32 of the upper packaging sheet 3 at the upper fin seal portion 2 in a lying state at the jetty 5 portion, especially at its end. When the internal pressure reaches a definite pressure, the inner layer film 2 of the upper packaging sheet 3 is broken to separate the inner layer film 32 from the outer layer film 31 around the end potion of the jetty 5, as shown in FIG. 5. The vapor enters the space formed by the separation, and spreads over the vapor pocket portion 71 and advances the first and second vapor passages 72, 73 with separating the inner layer film 32 from the outer layer film 31 to reach the first and second vapor ports 74, 75, and escapes therefrom.

The presence of the vapor pocket portion 71 having not ruptured portions surrounding the broken portion facillitates the separation at the first and second vapor passages 72, 73. In the non-sealed window portion 63, the bonding strength of the inner layer film 32 to the outer layer film 31 is weaker than the heat-sealed portion because of not pressed by the heat-sealing. Moreover, the non-sealed window portion 63 facillitates to warp the inner layer film 32 to separate from the outer layer film 31 there. Thus, the formation of the second vapor passage 73 is facilitated.

In the above packaging bag, since the first and second vapor passages 72, 73 are much narrower than the vapor pocket 71, the article to be cooked rarely boils over through the passages 72, 73. The inner layer film 32 is not broken through usual boiling or retort sterilization. In other words, the material, thickness or the like of the inner layer film, the type of the releasing agent, etc. can be varied so that the inner layer film is not ruptured by the designed boiling or retort sterilization conditions but broken by microwave heating.

Ingredients of a Chinese food (mabo tofu) were put in the above packaging bag, and heat-sealed. The package was allowed to stand one day in a freezer at −20° C., and then, heated in a 500 W microwave oven. After 4 minutes 30 seconds from the start of heating, the bag began to inflate. After 4 minutes 45 seconds, the inner layer film 32 was broken at the jetty portion 5, and vapor escaped from the first and second vapor ports 74, 75. After 5 minutes 20 seconds, the cooking of the Chinese food was completed.

Example 2

Figure 6:
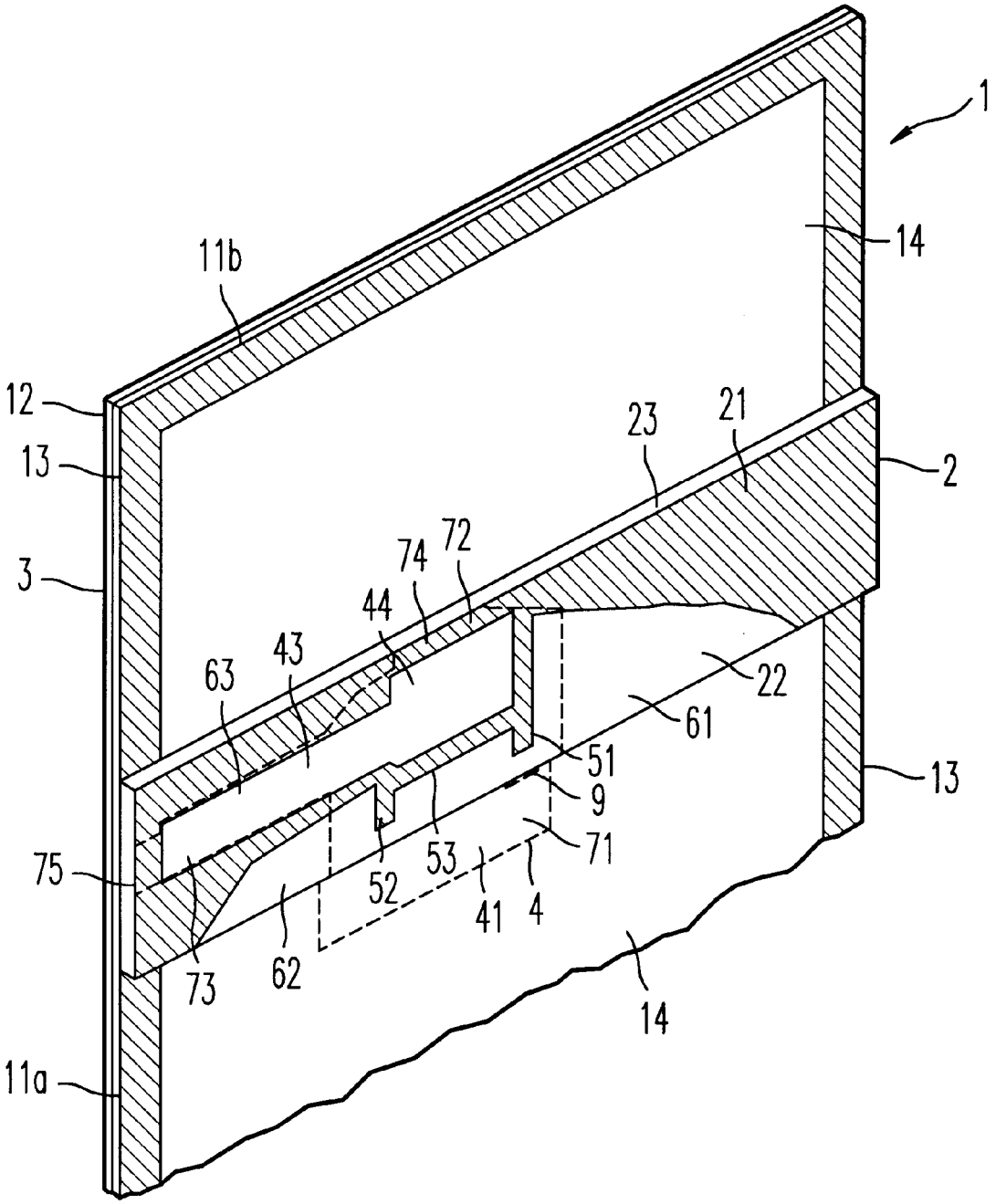
FIG. 6 is a partially perspective view of another packaging bag for a microwave oven embodying the invention.
Figure 7:
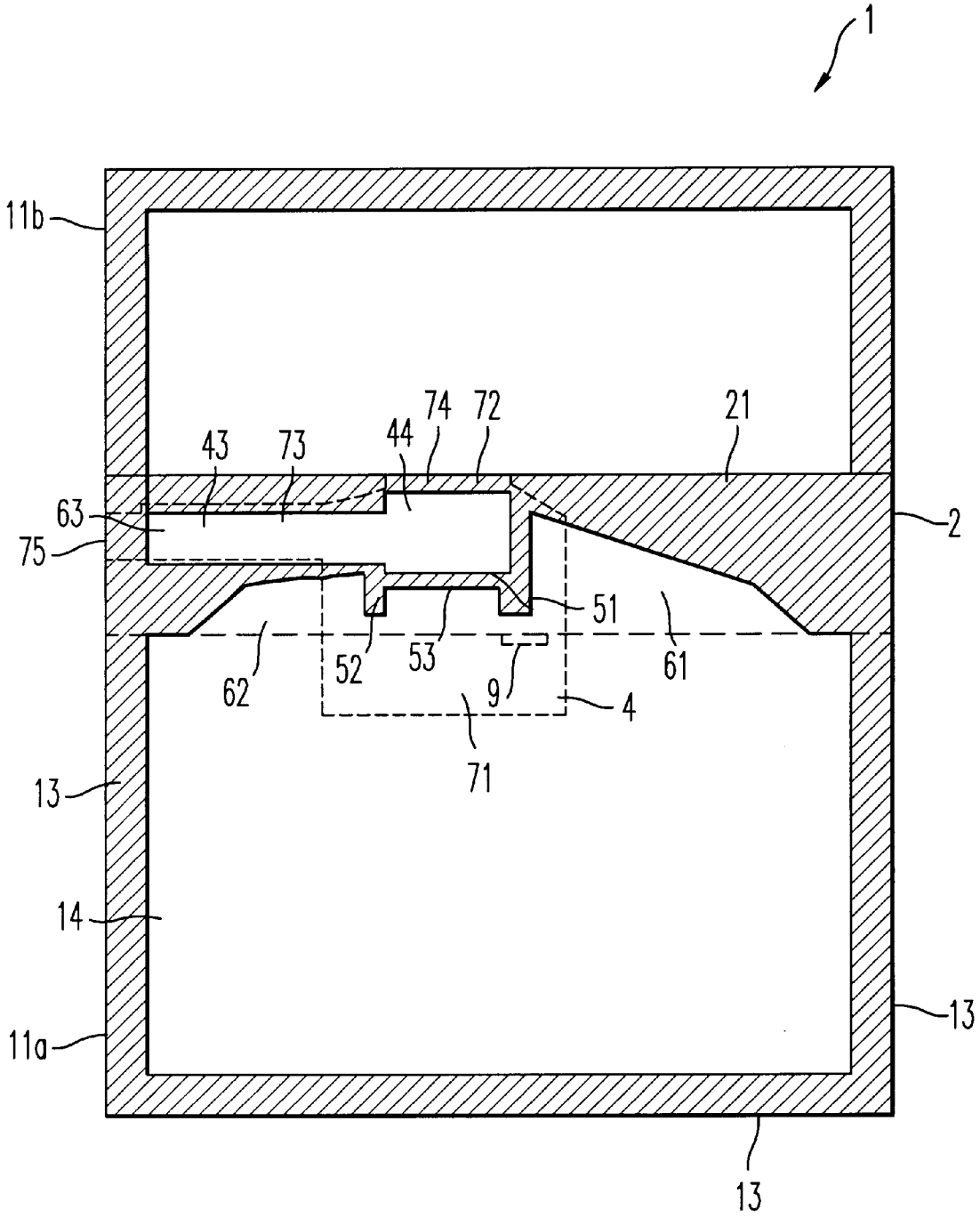
FIG. 7 is a plan view.
Figure 8:
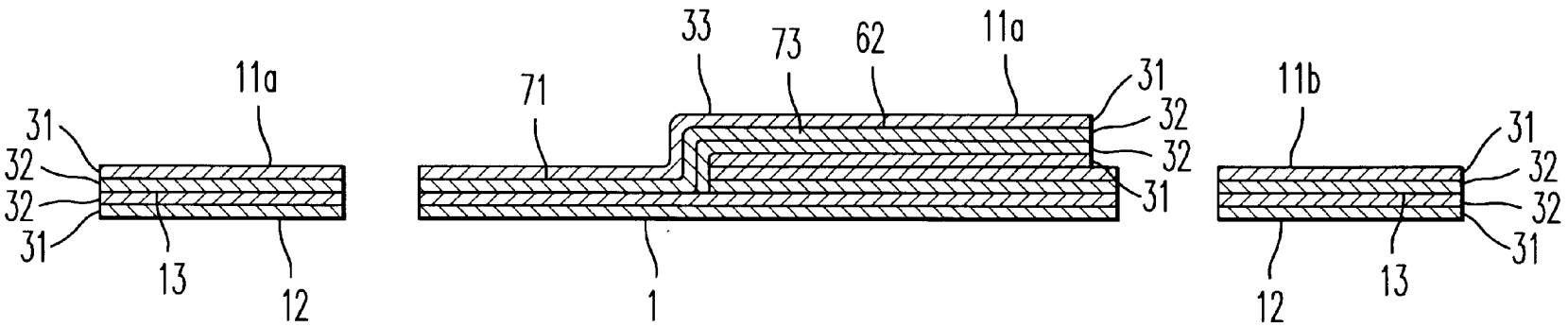
FIG. 8 is a partial section thereof.

Another example of the packaging bag of the invention is illustrated in FIGS. 6–8.

The bag is different from Example 1 in the number of the packaging sheets 11*a*, 11*b*, 12 forming the bag, the projected portion 5, the shape of the releasing agent layer 33, to provide a strongly joined spot portion 9, and the second subsidiary chamber 62, as follows:

The number of the packaging sheets is three, i.e. a left upper side sheet 11*a*, a right upper slide sheet l*b*, and an underside sheet 12. The left upper side sheet 11*a* and the right upper sheet 11*b* are superimposed to each other, and a side is heat-sealed to form the upper fin seal portion 2. Then, the unsealed sides are opened, superimposed on the underside sheet 12, and all sides are heat-sealed to form side film seal portions 13.

The projected portion consists of a pair of jetties 51, 52 connected by a bridge portion 53. In the projected portion, the expanding force is concentrated to both ends of the jetties 51, 52 to break the inner layer film there. The width of the first jetty 51 is made greater than die width of the second jetty 52, i.e. the end of the first jetty 51 is greater than the end of the second jetty 52. The greater end is made corresponding to the first subsidiary chamber 61 greater than the second subsidiary chamber 62, and thereby, the breakage of the inner layer film 32 occurs at both ends of the jetties 51, 52 almost simultaneously.

In the applied area of the releasing agent, the greatest rectangle portion 41 is widened, the smallest rectangle portion is changed into trapezoid 4, and the second vapor port 75 is narrowed. The widening of the greatest rectangle portion 41 is made corresponding to the greater jetty portion 51, 52, 53. The trapezoid portion 44 facillitates the formation of the first vapor port 74 together with thinning tile heat-sealed portion 21 there.

The releasing agent is not applied in the greatest rectangle portion 41 in spot under the first jetty 51. Accordingly, the outer layer film 31 is strongly joined there to the inner layer film 32 to form the strongly joined spot portion 9. The strongly joined spot portion 9 functions to restrict the movement of the inner layer film 32 upon pulled by the end of the first jetty 51, and thereby, to facillitates the breakage of the inner layer film 32 without great elongation. To render the elongation small results in no occurrence of closing the opening formed by the breakage by the elongated portion of the inner layer film 32.

The heat-sealed portion 21 at the second subsidiary chamber 62 is changed from the line in parallel to the free end 23 to an oblique line which facillitates to move vapor toward the second jetty 52.

The size of the bag is; a lateral bag width of 130 mm, a longitudinal bag width of 170 mm, a width of the side fin seal portions of 8 mm, a longitudinal width of the upper fin seal portion of 30 mm, a width of the first jetty 51 of 4.5 mm, a length of the first jetty 51 of 5.5 mm from the bridge portion 53, a width of the second jetty 52 of 3 mm, a length of the second jetty 52 of 5.5 mm from the bridge portion 53, a distance between the first jetty 51 and the second jetty 52 of 20. 5 mm, a width of the bridge portion 53 of 3 mm, a distance between the end of the first jetty 51 and the strongly joined spot portion 9 of 4 mm, a width of the greatest rectangle 41 of 41 mm, a length of the first vapor port of 20 mm, and a length of the second vapor port of 8 mm.

The above packaging bag was made using a biaxially stitched nylon film 15 μm in thickness as the outer layer film 31 printed with three-color printing using inks ("NEW LP SURER", Toyo Ink Mfg. Co., Ltd.) and a releasing agent ("SPV", prototype, Dainichi Seika Color & Chemicals Mfg. Co., Ltd.) by a gravue printing machine. The inner layer film 31 was a linear low density polyethylene film 50 μm in thickness, and laminated to the outer layer film 32 through an urethane adhesive ("Adcoat AD-900", Toyo Morton, Ltd.) by a dry laminator to obtain the packaging sheet 3.

The packaging sheet 3 was slitted in a width of 430 mm, wound, and made into the packaging bag leaving the front side non-sealed using an automatic high speed center press seal bag-making machine (Nishibe Kikai Kabushiki Kaisha) at a heat-sealing temperature of the upper fin seal portion of 230° C., a heat-sealing temperature of the side fin seal portions of 220° C. at a speed of 90 shots/min.

180 g of a commercial frozen food ("Chukadon-no-gu", Ajinomoto Co. Inc) was put in the above packaging bag through the front side, and heat-sealed. The package was heated in a microwave oven ("RE-PIF-A", Sharp) at 500 W for 5 minutes 30 seconds. After 4 minutes, the bag began to inflate, and after 4 minutes 30 seconds, vapor escaped from the first and second vapor ports 74, 75. After 5 minutes 30 seconds, the cooking of the frozen food was completed.

Subsequently, 100 bags of the above packaging bag were prepared, and 180 ml of water was packaged in each bag. Each bag was heated by the microwave oven for 5 minutes, and great inflation occurred in only 4 bags.

In comparison, 100 bags of a packaging bag as shown in Figure were prepared in the same size using the same packaging sheet, and 180 ml of water was packaged in each bag. Each bag was heated similarly, and great inflation occurred in 25 bags. It is apparent that the packaging bag of the invention can ensure the escape of vapor upon microwave heating.

Examples 3–9

Some modifications of the packaging bag of Example 2 are illustrated in FIGS. 9–15.

Figure 9:
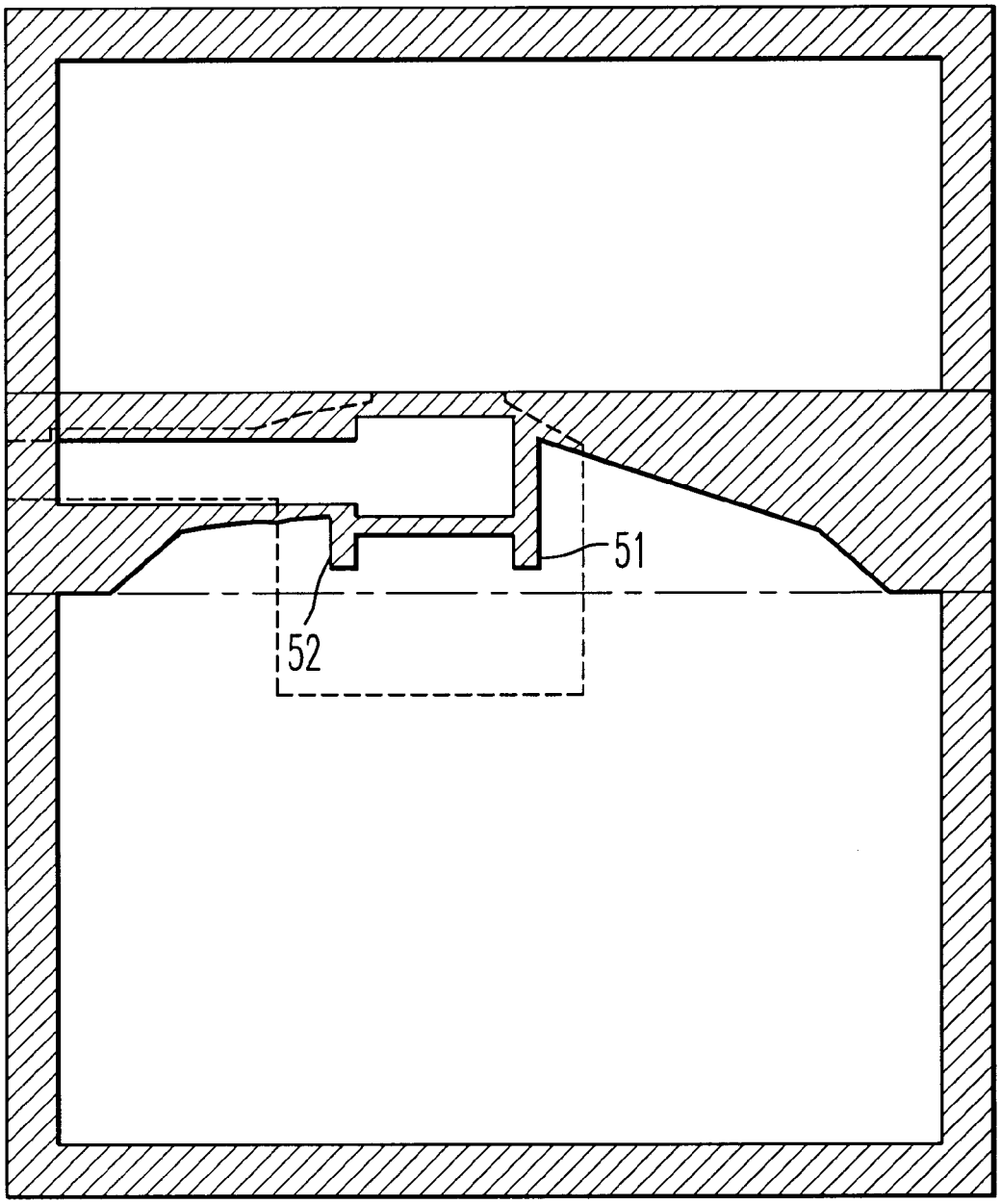
FIGS. 9–20 are plan views illustrating other packaging bags embodying the intention.

The packaging bag of FIG. 9 (Example 3) is varied mainly in the size of the width of the first jetty 51 from 4.5 mm to 3.5 mm, the distance between the first jetty 51 and the second jetty 52 from 20.5 mm to 18.5 mm.

Figure 10:
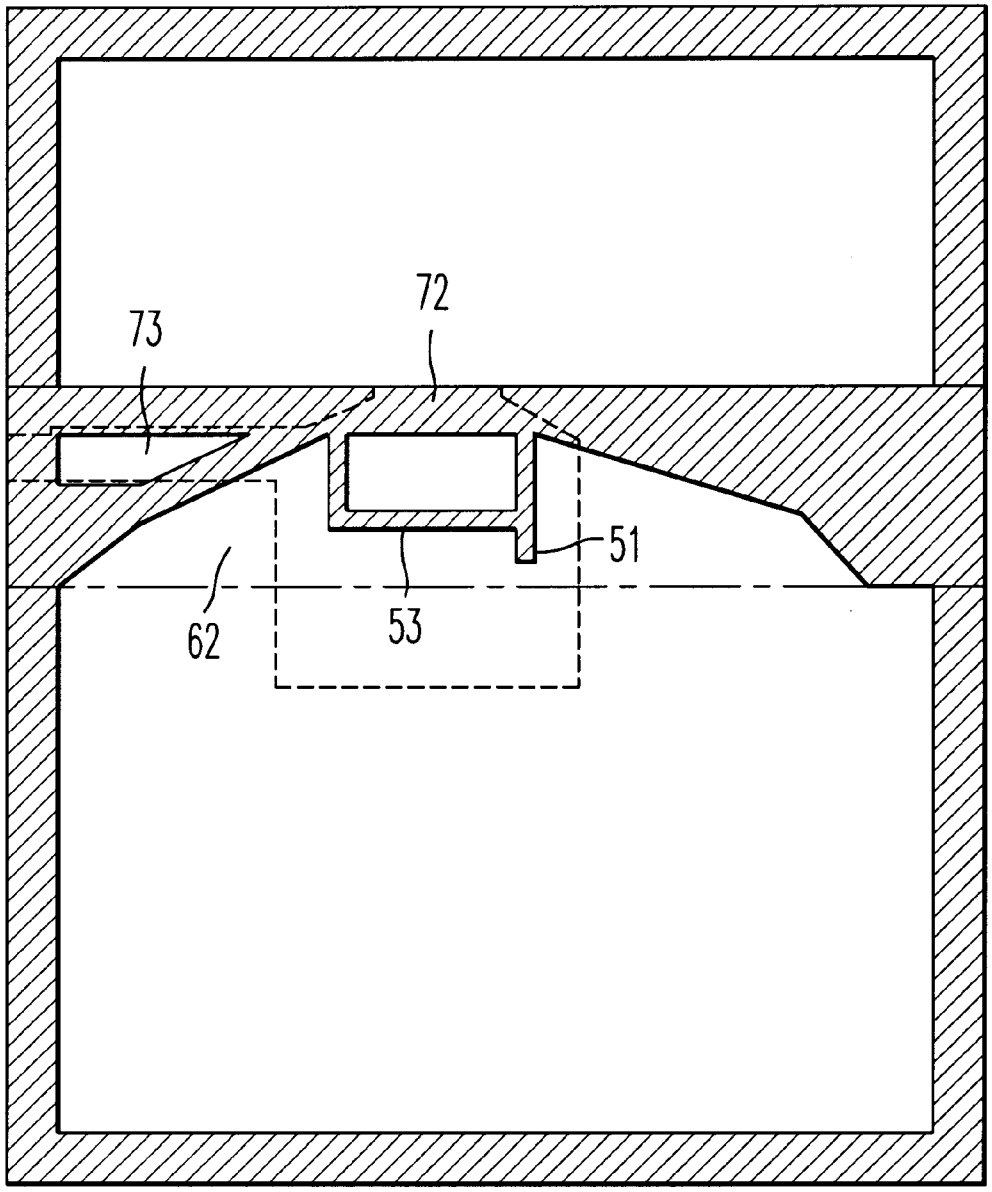

The packaging bag of FIG. 10 (Example 4) is varied mainly in not forming the second jetty and in making the second subsidiary chamber 62 greater and deeper. In the packaging bag, expansion occurs around the bridge portion 53 as the center of expansion, folding and wrinkling do not occur, and the vapor passages 72, 73 are not closed. The size of the bag is; a width of the first jetty 51 of 3 mm, and a length of the bridge portion 53 of 25 mm.

Figure 11:
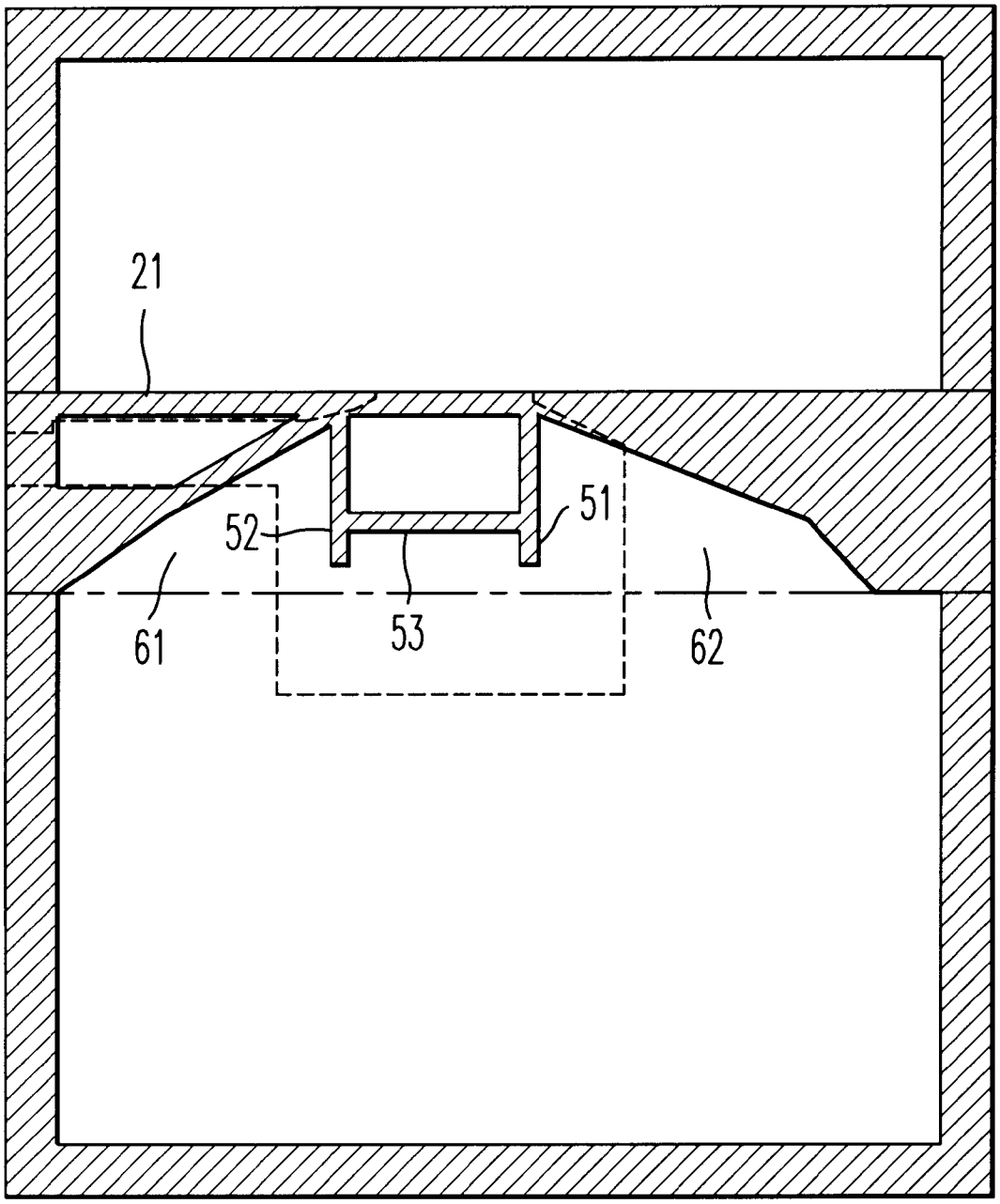

The packaging bag of FIG. 11 (Example 5) is the same as the packaging bag of Example 4, except that the second jetty 52 is formed and the upper side of the heat-sealed portion 21 is thinned, i.e. the first and second subsidiary chambers 61, 62 are deepened. Since the size of the second subsidiary chamber 62 is enlarged, the width of the second jetty 52 is made the same as the first jetty 51. The size of the packaging bag is; a width of the first jetty 51 of 3 mm, a width of the second jetty 52 of 3 mm, a distance between the first jetty 51 and the second jetty 52 of 19 mm, and a length of both the first and second jetties 51, 52 of 5 mm from the bridge portion 53.

Figure 12:
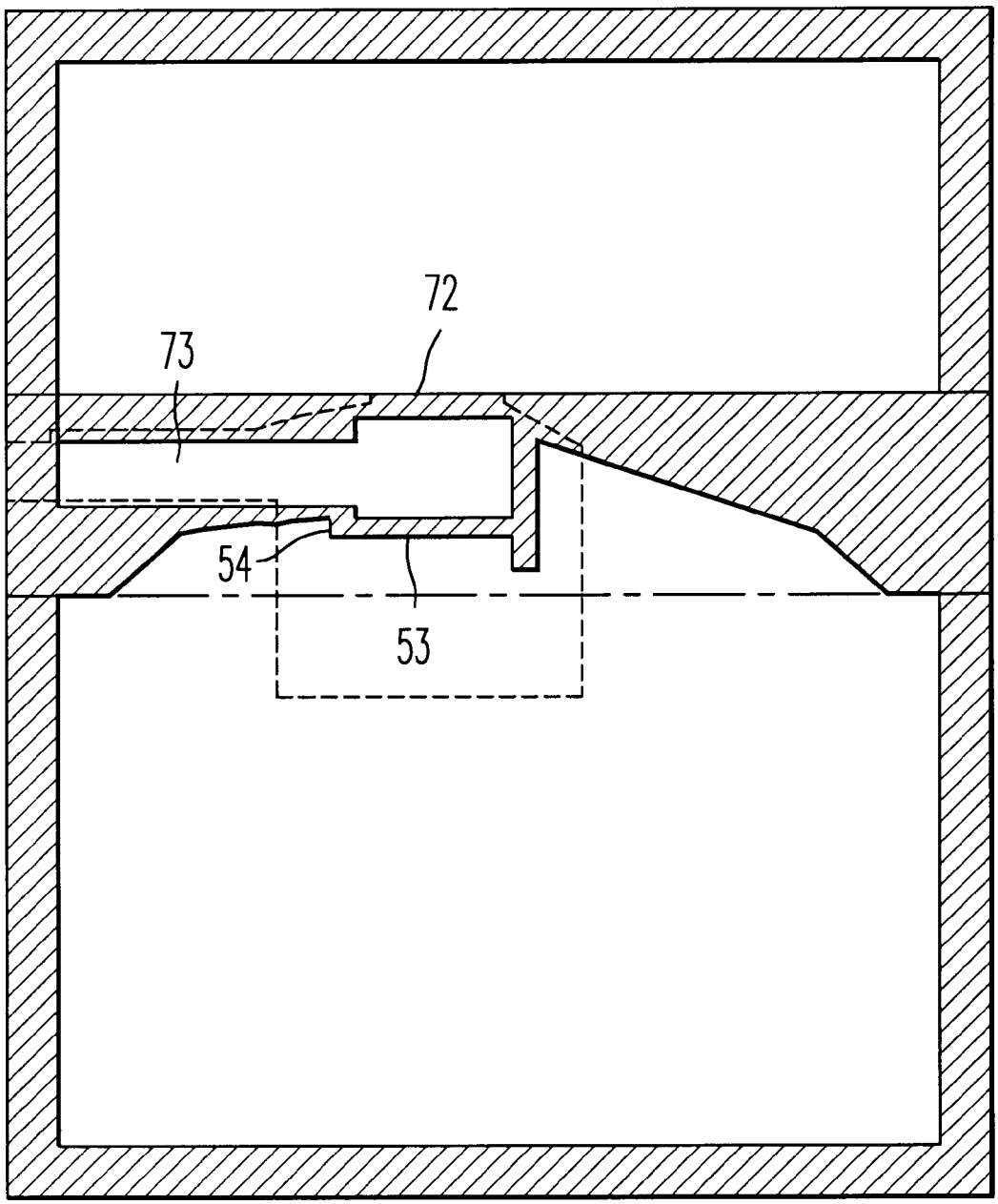

The packaging bag of FIG. 12 (Example 6) is similar to the packaging bag of Example 2, except that the second jetty 52 is not formed. In the packaging bag, expansion occurs around the bridge portion 53 as the center of expansion, folding and wrinkling do not occur, and the vapor passages 72, 73 are not closed. The length of the step portion 54 is 2 mm.

Figure 13:
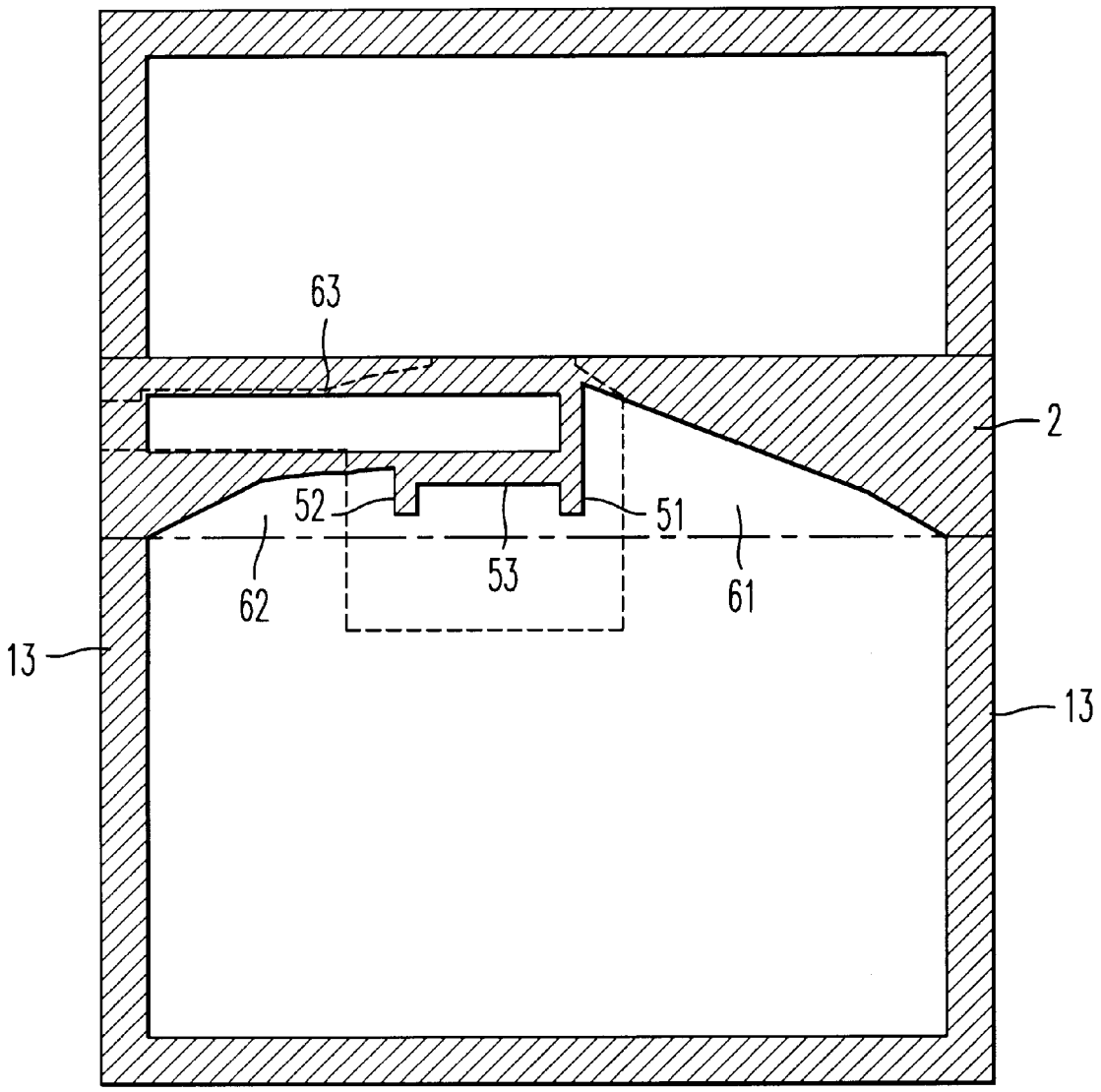

The packaging bag of FIG. 13 (Example 7) is similar to the packaging bag of Example 3, except that each side end of the first and second subsidiary chambers 61, 62 are extended to the side fin seal portions 13. In Example 3, each side end of the first and second subsidiary chambers 61, 62 are located inside by 5 mm than the side fin seal portion 13. The deepest end of the first subsidiary chamber 61 is located deep by 1 mm than the upper side of the non-sealed window portion 63. In Example 3, the deepest end is in the same level as the upper side of the non-sealed window portion 63. The distance between the first jetty 51 and the second jetty 52 is 23.5 mm. In Example 3, the distance is 18.5 mm. The other constitution and size are the same as Example 3. In the packaging bag of Example 7, since the center of inflation is located around the first vapor port 74 by sure standing of the upper fin seal portion 2 on both sides, i.e. the first subsidiary chamber 61 side and the second subsidiary chamber 62 side, escape of vapor occurs smoothly. The escape of vapor is smoother than the packaging bag of Example 3, caused by the extension of each side end of the first and second subsidiary chambers 61, 62.

Figure 14:
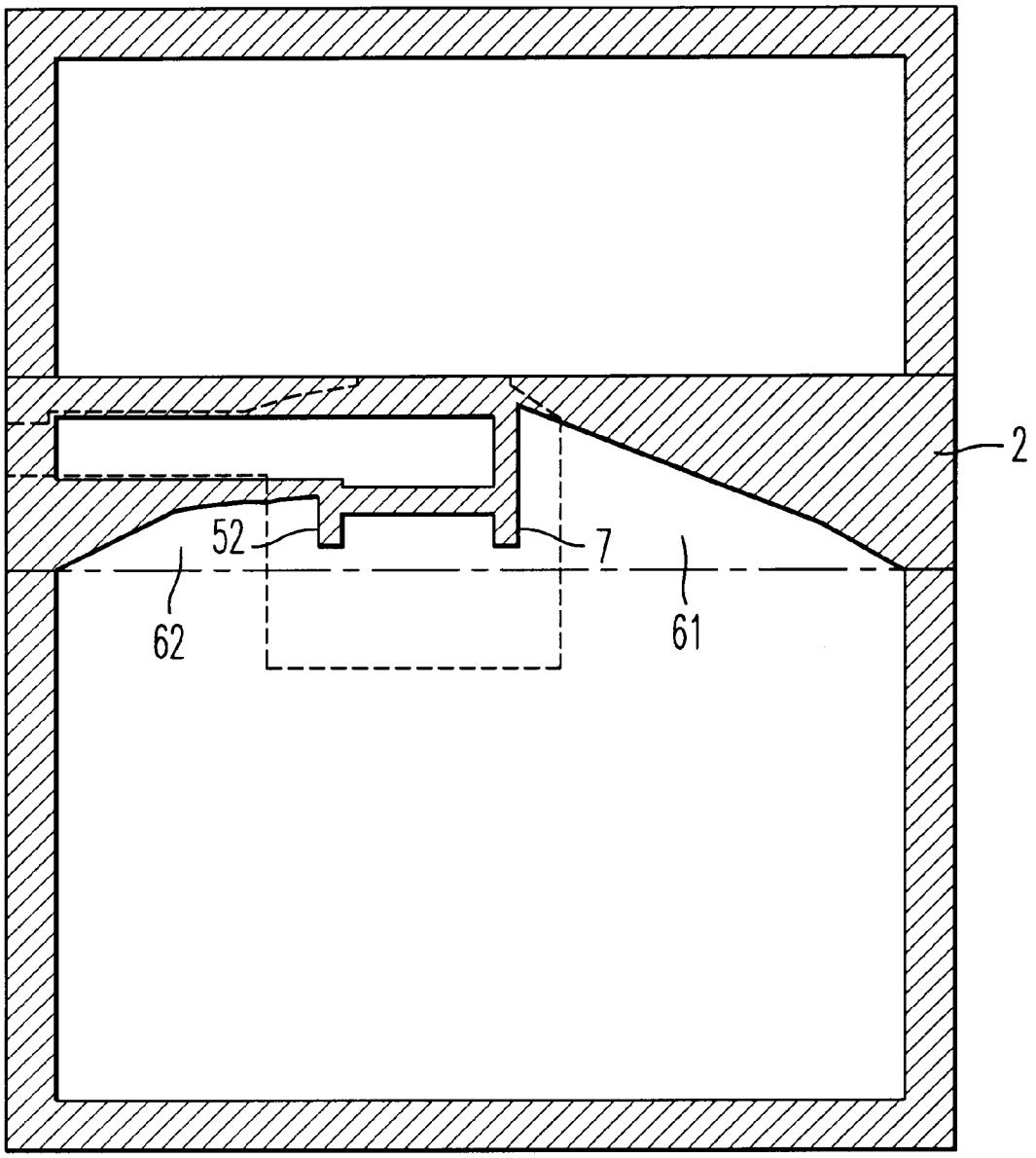

The packaging bag of FIG. 14 (Example 8) is the same as Example 7, except that the length of the second jetty 52 is shorted from 5.5 mm to 2 mm, and the distance between the first jetty 51 and the second jetty 52 is narrowed from 23.5 mm to 21.5 mm. The other constitution and size are the same as Example 7. In the packaging bag of Example 8, since the center of inflation is located around the first vapor port 74 by sure standing of the upper fin seal portion 2 on both sides, i.e. the first subsidiary chamber 61 side and the second subsidiary chamber 62 side, escape of vapor occurs smoothly. The escape of vapor is smoother than the packaging bag of Example 3, caused by the extension of each side end of the first and second subsidiary chambers 61, 62. In Example 8, the first jetty 51 is made longer than the second jetty 52. However, the first jetty 51 is made shorter than the second jetty 52. The difference of the length is, for example, about 1 to 4 mm.

Figure 15:
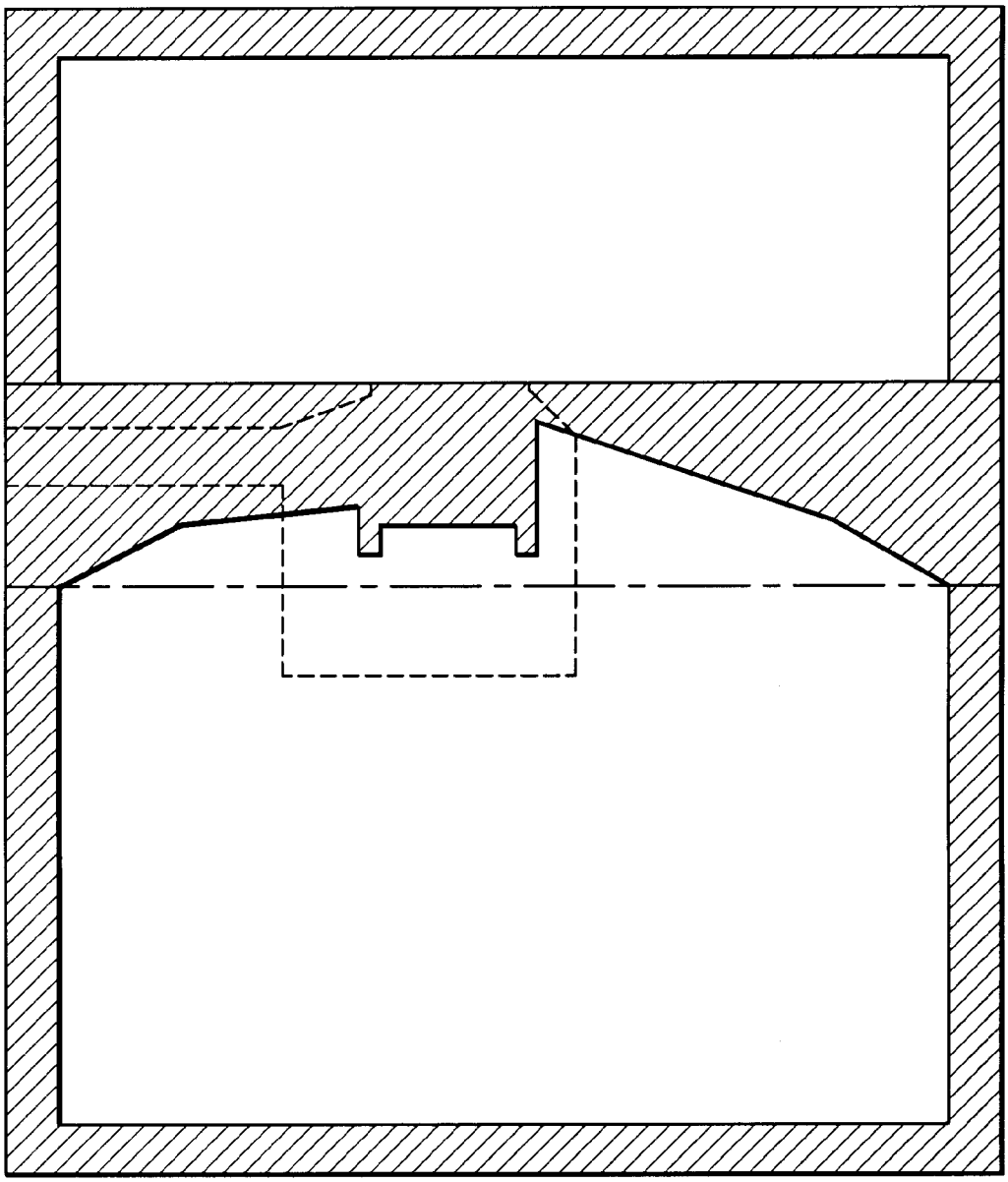

The packaging bag of FIG. 15 (Example 9) is the same as Example 7, except that the non-sealed window portion is not formed.

The packaging bag of Example 7 was made using a biaxially stretched nylon film 15 μm in thickness as the outer layer film 31 printed with three-color printing using inks ("NEW LP SUPER", Toyo Ink Mfg. Co., Ltd.) and a releasing agent ("SPV", prototype, Dainichi Seika Color & Chemicals Mfg. Co., Ltd.) by a gravue printing machine. The inner layer film 31 was a linear low density polyethylene film 50 μm in thickness, and laminated to the outer layer film 31 through an urethane adhesive ("Adcoat AD-900", Toyo Morton, Ltd.) by a dry laminator to obtain the packaging sheet 3.

The packaging sheet 3 was slitted in a width of 430 mm, wound, and made into the packaging bag using an automatic high speed center press seal bag-making machine (Nishibe Kikai Kabushiki Kaish) at a heat-sealing temperature of the upper fin seal portion 30 mm in longitudinal width of 240° C., a heat-sealing temperature of the side fin seal portions 8 mm in width of 190° C., 220° C. at both sides and of 180° C. at the bottom in FIG. 13, at a speed of 100 shots/min.

Then, the packaging bag was made under heat sealing conditions at a pressure of 1 kg/cm$^2$ at a temperature of 200° C. or 220° C. for 1 second. Then, the peel strength of the releasing agent-coated portion was measured, and summarized in Table 2.

TABLE 2

| | Temp. | 1 | 2 | 3 | 4 | 5 | 6 | 7 | 8 | 9 | 10 | g/15 mm width Average |
|---|---|---|---|---|---|---|---|---|---|---|---|---|
| Cyclized Rubber | 200° C. | 6.28 | 7.85 | 7.28 | 6.13 | 8.60 | 6.75 | 11.53 | 7.25 | 6.18 | 9.28 | 7.71 |
| | 220° C. | 16.25 | 11.10 | 12.58 | 11.00 | 12.00 | 12.95 | 15.08 | 11.23 | 13.55 | 11.95 | 12.77 |
| Cyclized Rubber + | 200° C. | 5.73 | 5.25 | 5.15 | 4.33 | 5.23 | 4.75 | 5.63 | 3.78 | 5.30 | 4.00 | 4.92 |
| Paraffin | 220° C. | 6.00 | 6.30 | 3.20 | 6.45 | 4.88 | 6.88 | 5.35 | 4.55 | 4.38 | 5.88 | 5.39 |
| Cyclized Rubber + | 200° C. | 3.95 | 2.80 | 3.78 | 3.98 | 3.00 | 3.75 | 3.45 | 3.08 | 3.90 | 4.00 | 3.57 |
| Paraffin + $BaSO_4$ | 220° C. | 3.15 | 3.00 | 3.25 | 2.75 | 2.33 | 2.50 | 3.08 | 2.45 | 3.00 | 2.75 | 2.88 |
| Nitrocellulose + Polyamide | 200° C. | 31.3 | 20.0 | 23.5 | 21.3 | 38.1 | 40.0 | 40.0 | 27.5 | 18.8 | 35.6 | 29.6 |
| Acrylic + Polyethylene | 200° C. | 45.2 | 37.8 | 48.2 | 39.9 | 43.7 | 22.1 | 36.9 | 37.5 | 33.7 | 45.2 | 39.0 |

180 ml of water was packaged in the bag, and heated by the microwave oven ("RE-PIF-A", Sharp), and generation of sound was observed. The results are shown Table 1.

TABLE I

| Upper Fin Seal | n | Bag-Rupture | Seal Recession | Sound Vapor | Upon Escape |
|---|---|---|---|---|---|
| Normal | 1000 | 0 | 0 | Bomb 3<br>Zing 9<br>Hiss 2 | Zing 8<br>Bomb >Hiss 6 |
| Reverse | 500 | 0 | 0 | Zing 5 | Hiss 2 |

In comparison, the packaging bag of Figure was also subjected to the test, and a sound rate in the normal state of the upper fin seal portion was about 50%.

In the packaging bags of the invention wherein the upper fin seal portion was folded in reverse, vapor escape only from the first vapor port was rare, and vapor escaped from both the first and second vapor ports simultaneously or escaped only from the second vapor port.

A packaging bag of FIG. 10 which is a modification of Example 4 was prepared. The size of the bag was 150 mm in lateral width, 173 mm in longitudinal width and 25 mm ill the longitudinal width of the upper fin seal portion 2. The outer layer film was a biaxially stretched nylon film 25 $\mu$m in thickness printed with three-color printing using inks ("NEW LP SUPER", Toyo Ink Mfg. Co., Ltd.) and a releasing agent by a gravure printing machine.

As the releasing agent, five types were used. The first was composed of 25 wt. % cyclized rubber ("POLYSTAR MEDIUM", Dainichi Seika Color & Chemicals Mfg. Co., Ltd.), 65 wt. % toluene and 10 wt. % n-propyl alcohol. The second was a mixture of 100 parts by weight of the cyclized rubber and 6 parts by weight of paraffin ("POLYCON LSM-44"). The third was a mixture of 100 parts by weight the cyclized rubber, 3 parts by weight of the paraffin and 3 part by weight of barium sulfate. The fourth was a mixture of nitrocellulose and polyamide. The fifth was a mixture of acrylic resin and polyethylene.

The inner layer film 32 was a cast (unstretched) polypropylene film (ethylene-polypropylene block copolymer film) 50 $\mu$m in thickness, and laminated to the outer layer film 31 through an urethane adhesive ("TM-225", Toyo Mortor, Ltd.) by a dry laminator to obtain the packaging sheet 3.

In the case of using the cyclized rubber alone as the releasing agent, the generation rate of rejected bags was 1.7%. In the case of using the mixture of the cyclized rubber, paraffin and barium sulfate, the generation rate of rejected bags was zero %. Another packaging bag of FIG. 10 which is a modification of Example 4 was prepared. The size of the bag was 150 mm in lateral width, 173 mm in longitudinal width and 25.5 mm in the longitudinal width of the upper fin seal portion 2. The outer layer film was a biaxially stretched nylon film 25 $\mu$m in thickness printed with three-color printing using inks ("NEW LP SUPER", Toyo Ink Mfg. Co., Ltd.) and cyclized rubber ("POLYSTAR MEDIUM", Dainichi Seika Color & Chemicals Mfg. Co., Ltd.) as the releasing agent by a gravure printing machine.

As the inner layer film 32, the following four cast polypropylene (all ethylene-polypropylene block copolymer) films each 50 $\mu$m in thickness were tested.

TABLE 3

| | Sample 1 | Sample 2 | Sample 3 | Prototype |
|---|---|---|---|---|
| Impact strength 20° C. | 340 | 330 | 243 | 116 |
| Kg-cm/mm −5° C. | 130 | 110 | 81 | 41 |
| Tear Strength with Notch MD | 17 | 16 | 8.5 | 3.2 |
| Kg/cm TD | 48 | 43 | 38 | 61 |
| TD/MD | 2.8 | 2.7 | 4.5 | 19 |

Impact strength: Pendulum impact tester "FILM IMPACT TESTER" (Toyo Sciki Seisaku-Sho, Ltd.) haing a 1.5 inches ball as the impactor Tear strength: Elmendorf tearing tester, at 20° C.

Each inner layer film 32 was laminated to the outer layer film 31 through an urethane adhesive ("Adcoat AD-900", Toyo Morton, Ltd.) by a dry laminator to obtain the packaging sheet 3. The packaging sheet 3 was slitted in a width of 430 mm, wound, and made into the packaging bag leaving the front side non-sealed using an automatic high speed center press seal bag-making machine (Nishibe Kikai Kabushiki Kaisha) at a heat-sealing temperature of the upper fin seal portion of 245° C., a heat-sealing temperature of the side fin seal portions of 220° C. at a speed of 90 shots/min.

180 ml of water was put in the above packaging bag through the front side, and heat-sealed. The package was heated in a microwave oven ("RE-PIF-A", Sharp) at 500 W for 4 minutes. After 2 minutes 40 seconds, vapor began to escape from the vapor port, and the vapor escape was continued up to the termination of microwave heating. The results of the microwave heating test are summarized in Table 4.

TABLE 4

| | n | Bag Rupture | Retraction*1 of Sealed Portion |
|---|---|---|---|
| Sample 1 | 100 | 5 | 55 |
| Sample 2 | 100 | 3 | 23 |
| Sample 3 | 1000 | 0 | 3*2 |
| Prototype | 3000 | 0 | 0 |

*1Occurred at the right side of the upper fin seal portion
*2Retracted length: 2–4 mm Examples 10–14

Some other packaging bags of the invention are illustrated in FIGS. 16–20.

Figure 16:
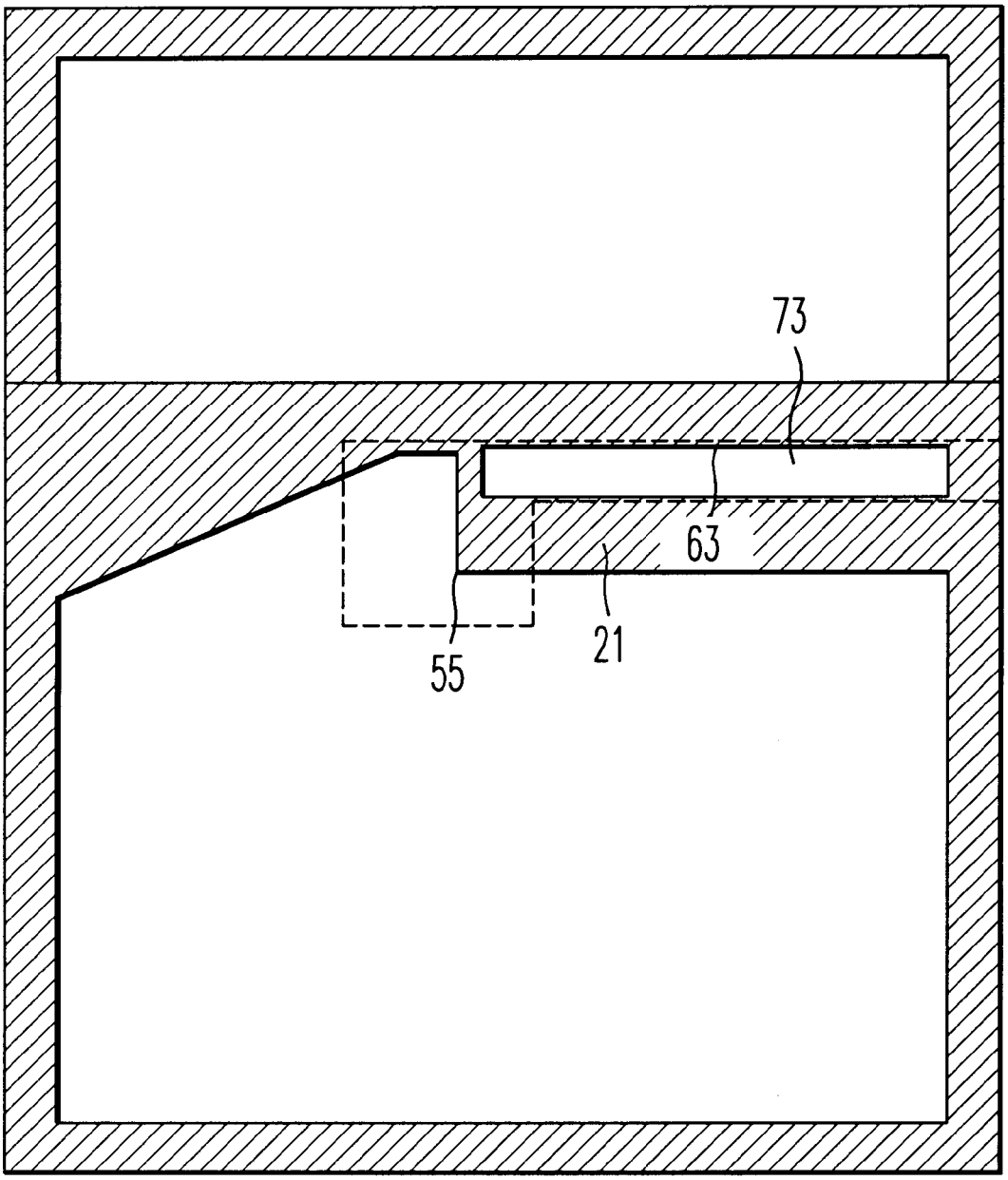

The packaging bag of FIG. 16 (Example 10) is similar to the packaging bag of Example 1 wherein the jetty and the smallest rectangle portion are not formed. In the packaging bag, the corner 55 of the heat-sealed portion 21 under the non-sealed window portion 63 functions as the projected portion for breaking the inner layer film, and vapor escapes through the second vapor passage 73.

Figure 17:
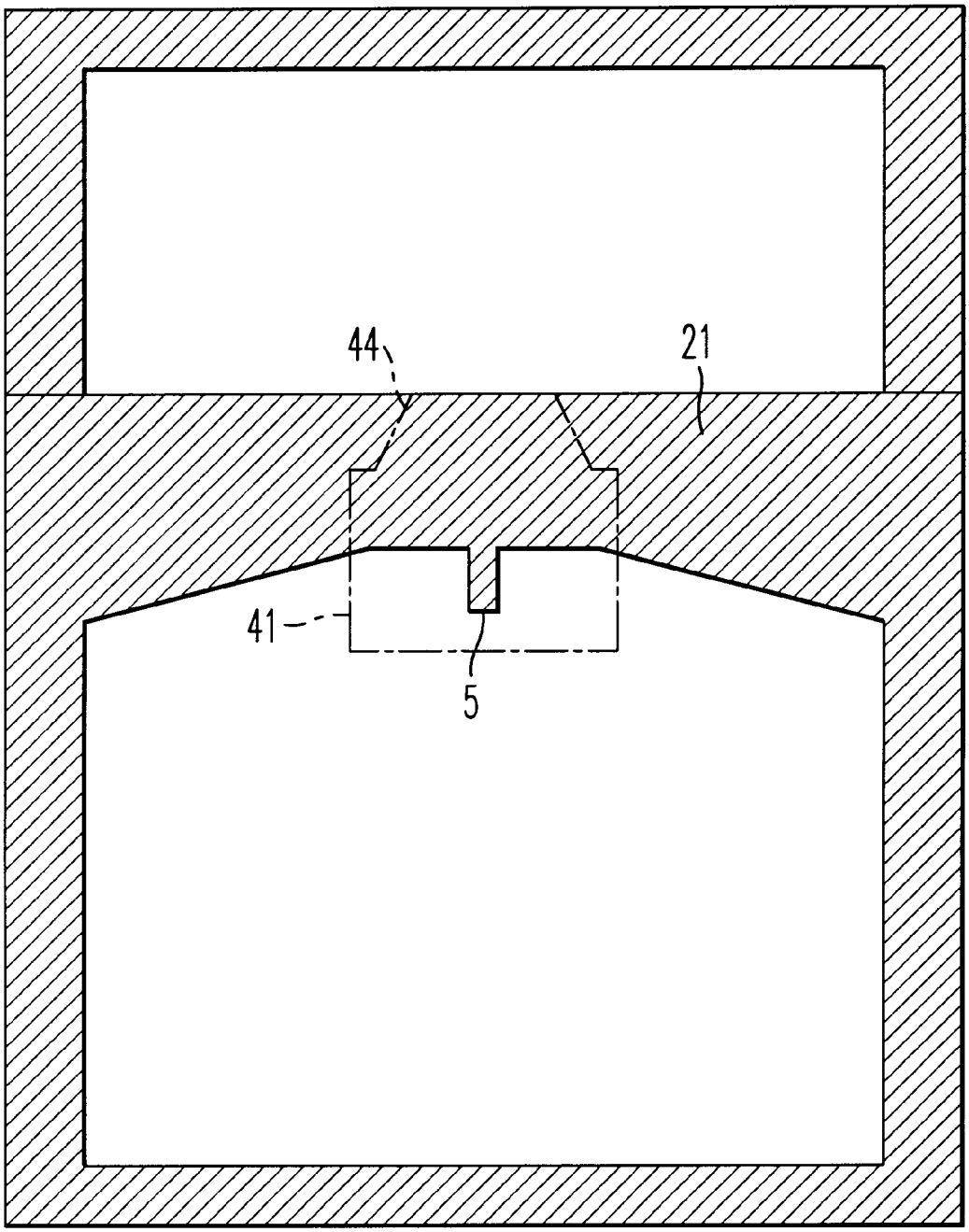

In the packaging bag of FIG. 17 (Example 1), the underside of the heat-sealed portion 21 is formed in a trapezoid, and the jetty 5 is formed at the center. The releasing agent is applied to the area surrounded by a dashed line, i.e. a combination of a greatest rectangle portion 41 and a trapezoid portion 44, to form a weakly zoined portion 4.

Figure 18:
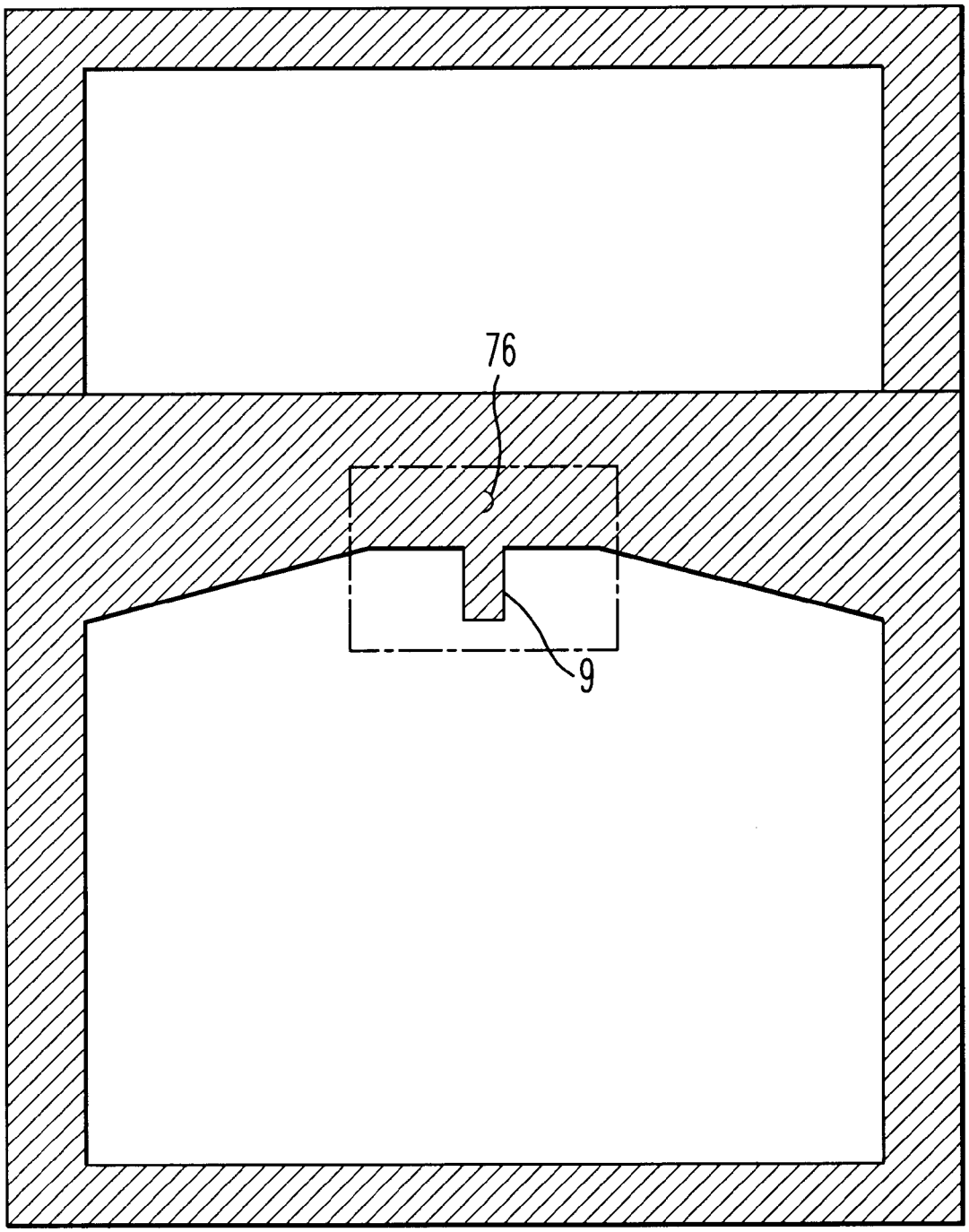

In the packaging bag of FIG. 18 (Example 12), the trapezoid portion is not formed, and instead, a U-shaped notch 76 is provided as the vapor port.

Figure 19:
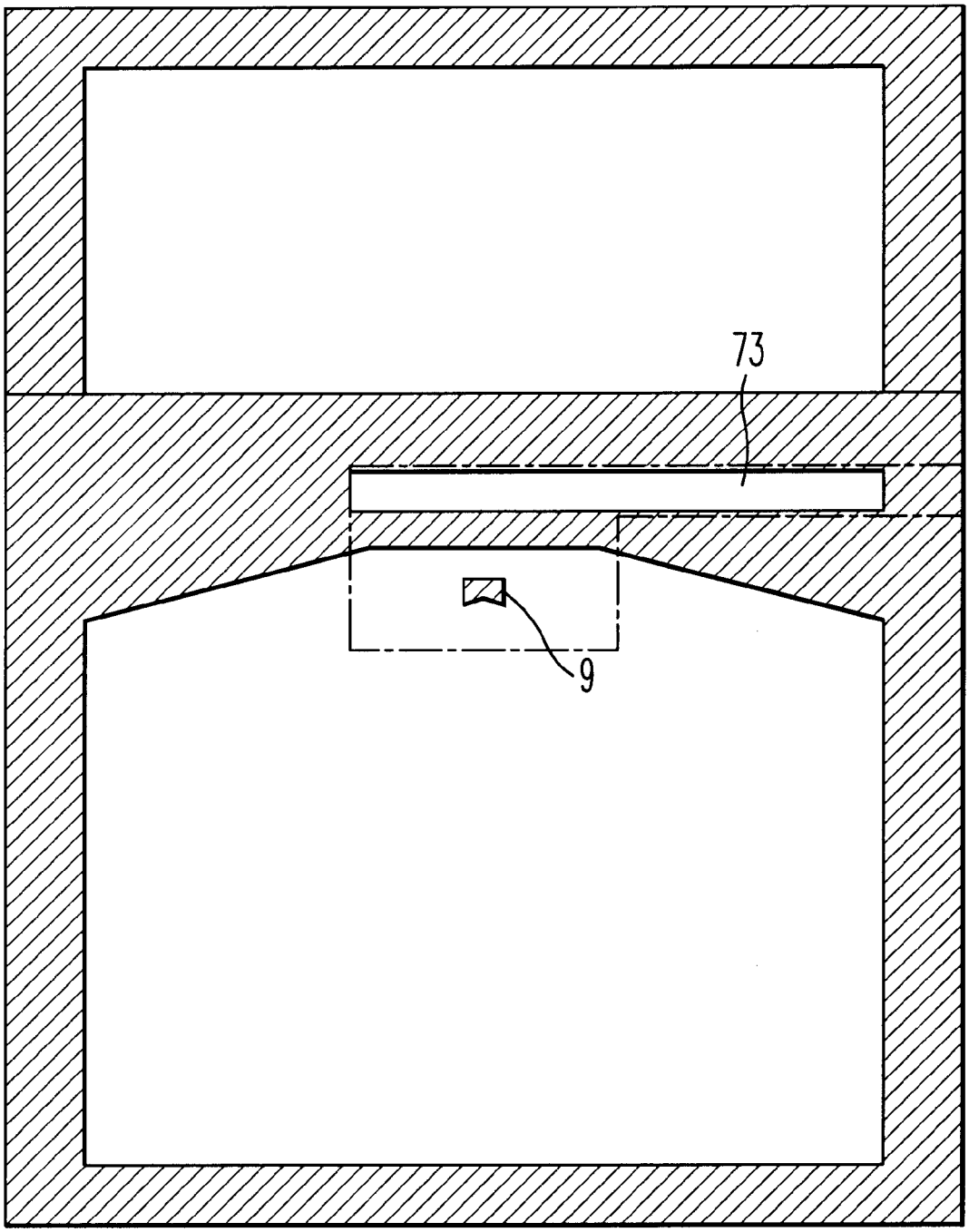

In the packaging bag of FIG. 19 (Example 13), a strongly joined spot portion 9 is provided for breaking the inner layer film instead of the jetty, and the releasing agent is applied to the area surrounded by a dashed line. Vapor escapes through the second vapor passage 73.

Figure 20:
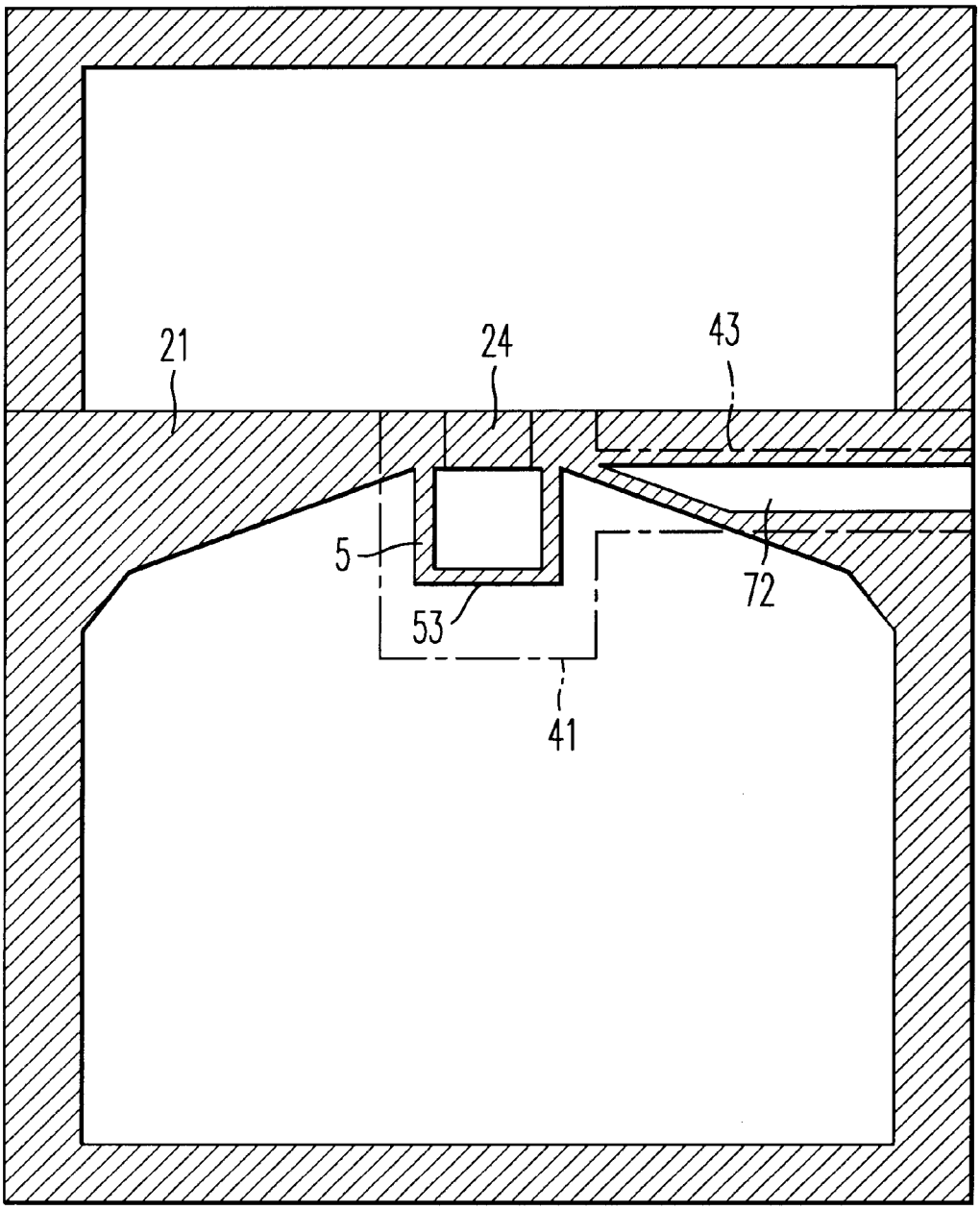

In the packaging bag of FIG. 20 (Example 14), the projected portion 5 is in a form of square frame, and the bridge portion 53 functions for breaking the inner layer film. The releasing agent is applied to the area surrounded a dashed line, i.e. a combination of a greatest rectangle portion 41 and a right rectangle portion 43. A weakly heat-sealed portion 24 is provided at the center of the upper side of the heat-sealed portion 21 for facilitating to form the first vapor passage 72.

Examples 15–19

Some other packaging bags of the invention are illustrated in FIGS. 21–25, wherein the upper fin seal portion 2 stands.

Figure 21:
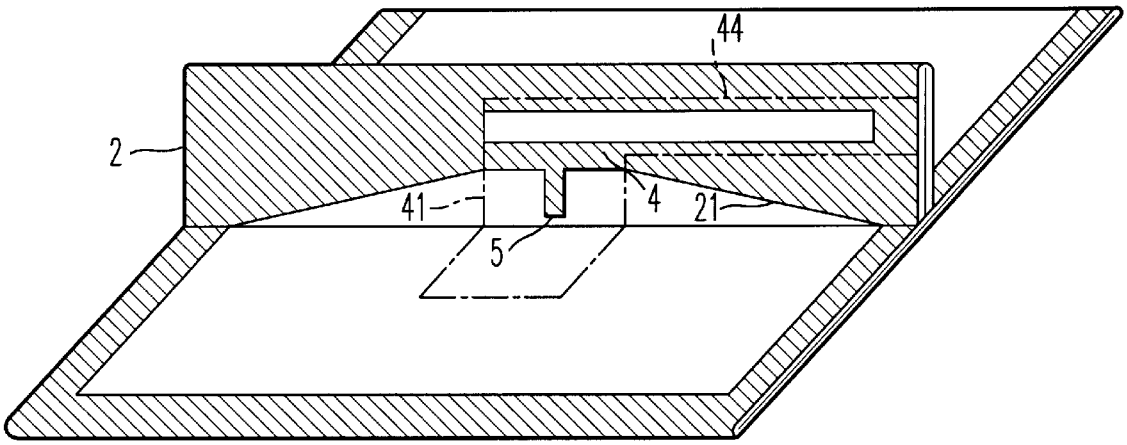
FIGS. 21–25 are perspective views illustrating still other packaging bags embodying the invention.

In the packaging bag of FIG. 21 (Example 15), the underside of the heat-sealed portion 21 is formed in a trapezoid, and the jetty 5 is formed at the center. The releasing agent is applied to the area surrounded by a dashed line, i.e. a combination of a greatest rectangle portion 41 and a right rectangle portion 43, to form a weakly coined portion 4.

Figure 22:
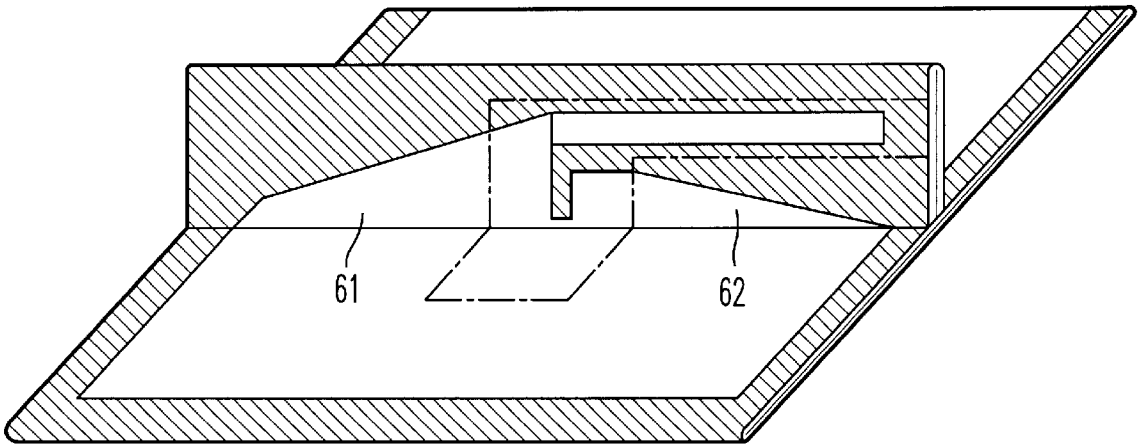

In the packaging bag of FIG. 22, the first and second subsidiary chambers 61, 62 are enlarged similar to FIG. 13, compared with the packaging bag of FIG. 21.

Figure 23:
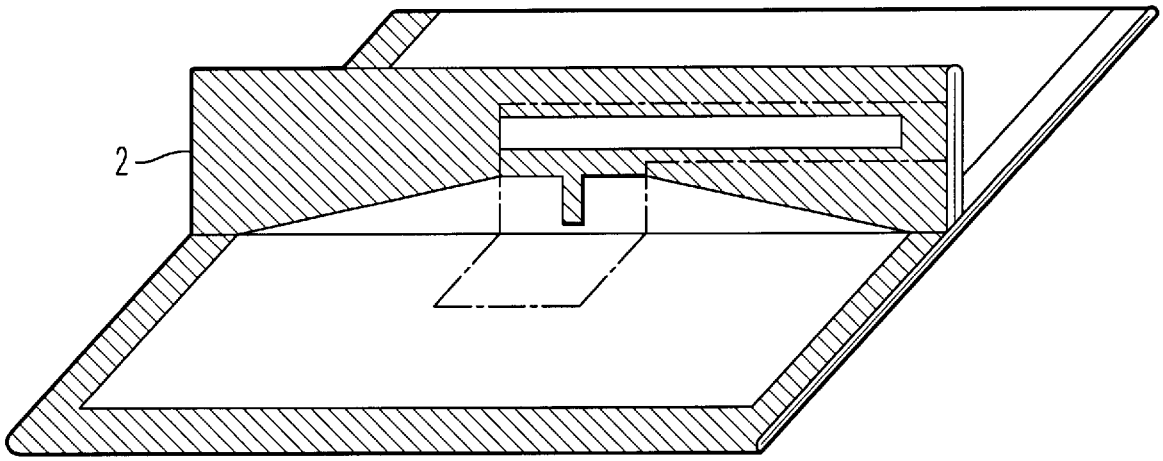

The packaging bag of FIG. 23 is the same as the packaging bag of FIG. 21, except that the upper fin seal portion 2 is not formed by heat-sealing superimposed ends of the packaging sheet, but formed by heat-sealing a folded portion formed in the midway of the packaging sheet.

Figure 24:
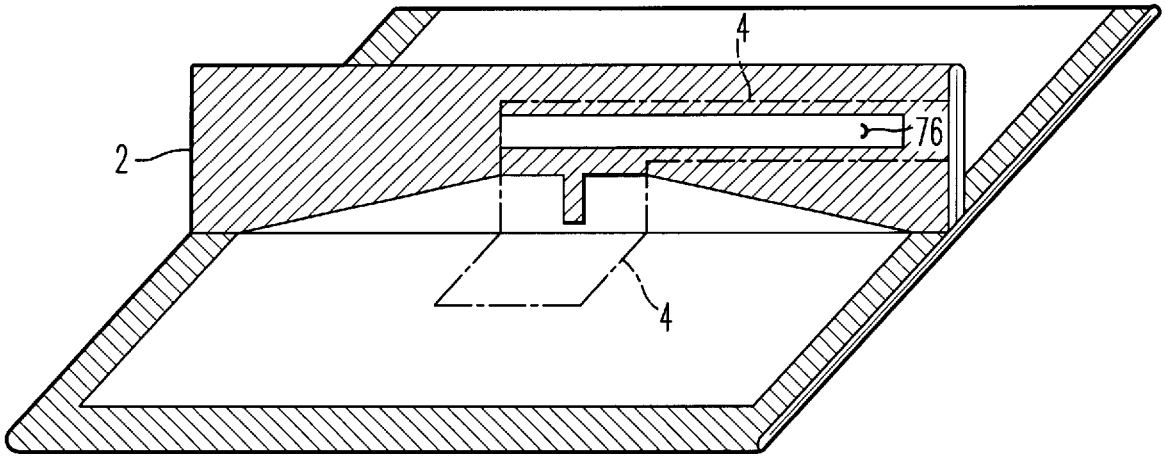

The packaging bag of FIG. 24 is the same as the packaging bag of FIG. 21, except that the weakly joined portion 4 on the right end does not reach the side end of the upper fin seal portion 2, and a notch 76 is formed near the right end.

Figure 25:
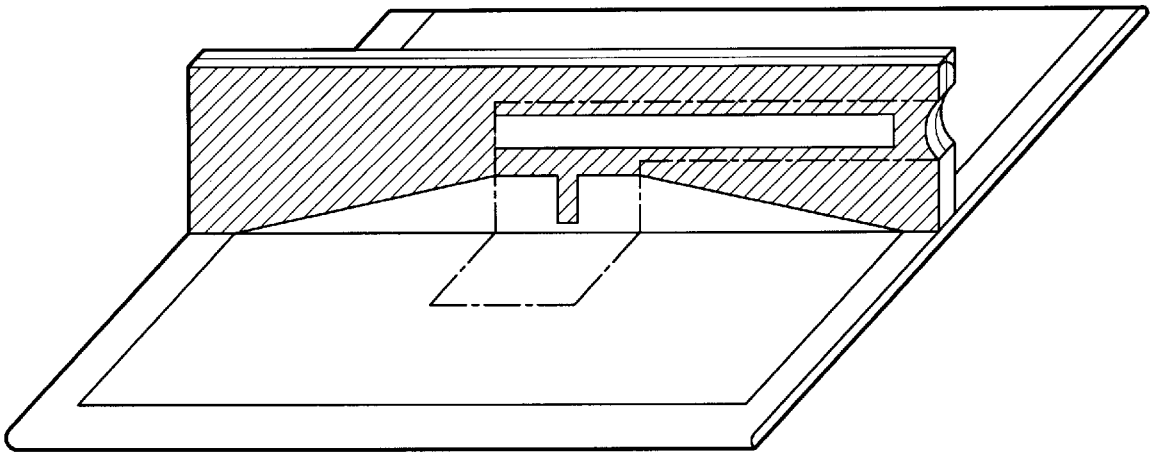

The packaging bag of FIG. 25 is the same as the packaging bag of FIG. 21, except that the right end of the weakly joined portion is cut off in are to form a recess 77. Thereby, vapor exhaust sound can be made smaller.

We claim:

1. A packaging bag for use in a microwave oven, said packaging bag comprising a bag body comprising an upper side sheet portion and an underside sheet portion and an upper fin seal portion formed on the upper side sheet portion, wherein said upper fin seal portion is formed of heat-sealed laminated films comprising an inner layer film and an outer layer film, and wherein said upper fin seal portion comprises a non-sealed portion connecting with a container portion of the bag body, a heat-sealed portion extending about a portion of said upper fin seal portion, a heat-sealed projected portion projected from said heat-sealed portion, and a weakly joined portion having a peel strength of 0.1 to 15 g/15 mm width formed between the inner layer film and the outer layer film at least surrounding the projected portion and connected with an outside end of the upper fin seal portion.

2. The packaging bag of claim 1 wherein the projected portion is in a jetty-shaped.

3. The packaging bag of claim 1, wherein the projected portion is in a shape of a combination of a jetty and a bridge.

4. The packaging bag of claim 1, wherein the non-sealed portion connecting with the container portion is made deeper toward the projected portion.

5. The packaging bag of claim 1, wherein a further non-sealed portion is formed above the projected portion, and overlapped with the weakly joined portion.

6. The packaging bag of claim 1, wherein the upper fin seal portion is imparted with turning habit, and lies on one side.

7. The packaging bag of claim 1, wherein a strongly joined spot portion is provided under the underside end of the projected portion.

8. A packaging bag for a microwave oven which comprises a bag body comprising an upper side sheet portion and an underside sheet portion and an upper fin seal portion formed on the upper side sheet portion, wherein said upper fin seal portion is formed of heat-sealed laminated films comprising an inner layer film and an outer layer film, wherein said upper fin seal portion comprises a non-sealed portion connecting with a container portion of the bag body, a projected portion projected from an inside end of a heat-sealed portion, and a weakly joined portion having a peel strength of 0.1 to 15 g/15 mm width formed between the inner layer film and the outer layer film at least surrounding the projected portion and connected with an outside end of the upper fin seal portion, and wherein the inner layer film has an impact strength of 50 to 200 kg·cm/mm at 20° C.

9. The packaging bag of claim 1 wherein the inner layer film has a ratio of notched tear strength in lateral direction/notched tear strength in longitudinal direction of 4 or more.

10. The packaging bag of claim 1, wherein the weakly joined portion is formed by providing a releasing agent.

11. The packaging bag of claim 10, wherein the releasing agent is a mixture of a releasing agent and a lubricant or an inorganic filler.

12. A packaging bag comprising:

a bag body having an upper side sheet portion, an underside sheet portion, and an upper fin seal portion integral with said upper side sheet portion, wherein:

said upper side sheet portion and said underside sheet portion defining a container portion, said upper fin seal portion is formed of heat-sealed laminated film having an inner layer and an outer layer, and said upper fin seal portion includes an interior non-sealed portion connected with said container portion, a heat-sealed projected portion extending adjacent to said non-sealed portion, and a weakly joined portion having a peel strength of 0.1 to 15 g/15 mm width formed between said inner layer and said outer layer at least surrounding said projected portion and connected with an outside edge of said upper fin seal portion.

* * * * *